US006943644B2

(12) United States Patent
Hidaka et al.

(10) Patent No.: US 6,943,644 B2
(45) Date of Patent: Sep. 13, 2005

(54) RESONATOR, FILTER, DUPLEXER, AND COMMUNICATION APPARATUS

(75) Inventors: Seiji Hidaka, Nagaokakyo (JP); Shin Abe, Muko (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 10/643,692

(22) Filed: Aug. 18, 2003

(65) Prior Publication Data

US 2003/0234704 A1 Dec. 25, 2003

Related U.S. Application Data

(63) Continuation of application No. PCT/JP02/13181, filed on Dec. 17, 2002.

(30) Foreign Application Priority Data

| | | |
|---|---|---|
| Dec. 18, 2001 | (JP) | 2001-384879 |
| Dec. 18, 2001 | (JP) | 2001-384879 |
| Nov. 18, 2002 | (JP) | 2002-334226 |
| Dec. 16, 2002 | (JP) | 2002-363359 |

(51) Int. Cl.[7] ..... H01P 1/213; H01P 1/20; H01P 7/00

(52) U.S. Cl. ..... 333/126; 333/202; 333/219; 333/204

(58) Field of Search ..... 333/202, 126–128, 333/204, 205, 219, 99 S

(56) References Cited

U.S. PATENT DOCUMENTS

| | | | | |
|---|---|---|---|---|
| 4,641,116 A | * | 2/1987 | Shibata et al. | 333/204 |
| 4,721,931 A | * | 1/1988 | Nishikawa et al. | 333/203 |
| 4,749,963 A | | 6/1988 | Makimoto et al. | 331/99 |
| 5,055,809 A | * | 10/1991 | Sagawa et al. | 333/219 |
| 5,922,650 A | * | 7/1999 | Ye | 505/210 |
| 6,122,533 A | * | 9/2000 | Zhang et al. | 505/210 |
| 6,486,754 B1 | * | 11/2002 | Hidaka et al. | 333/219 |
| 6,509,810 B2 | * | 1/2003 | Ota et al. | 333/134 |
| 6,538,527 B2 | * | 3/2003 | Hidaka et al. | 333/99 S |
| 6,624,727 B2 | * | 9/2003 | Hidaka et al. | 333/202 |
| 6,633,207 B1 | * | 10/2003 | Hidaka et al. | 333/134 |

FOREIGN PATENT DOCUMENTS

| | | |
|---|---|---|
| JP | 62-183202 | 8/1987 |
| JP | 62-193302 | 8/1987 |
| JP | 02-096402 | 4/1990 |
| JP | 03-181203 | 8/1991 |
| JP | 09-083219 | 3/1997 |
| JP | 2000-049512 | 2/2000 |
| JP | 2000-244213 | 9/2000 |
| JP | 2001-077609 | 3/2001 |
| JP | 2002-009503 | 1/2002 |
| JP | 2002-009515 | 1/2002 |
| JP | 2002-009516 | 1/2002 |

OTHER PUBLICATIONS

Korean Office Action issued Jun. 14, 2005 (w/ English translation).

* cited by examiner

*Primary Examiner*—Barbara Summons
(74) *Attorney, Agent, or Firm*—Dickstein, Shapiro, Morin & Oshinsky, LLP.

(57) ABSTRACT

Ring-shaped resonant elements include respectively conductor lines 2*a*, 2*b*, and 2*c* each formed on a substrate 1 along a full one turn of circumferential length of a ring. Each of the conductor lines 2*a*, 2*b*, and 2*c* has two end portions which additionally extend and which are located such that they closely adjoin each other in a width direction. The respective ring-shaped resonant elements are disposed in a concentric fashion. Capacitive parts are formed in areas in which two ends of respective conductor lines are located in close proximity to each other, and the other parts of the respective conductor lines function as inductive parts. Each conductor line operates as a half-wave transmission line whose both ends are electrically open. It is not needed to form a ground electrode on a surface of the substrate opposite to the surface on which the conductor lines are formed. Thus, a resonator can be formed using a very small number of constituent elements. A resonator, a filter, a duplexer, and a communication apparatus having a small size and a high conductor Q-factor can be produced at reasonably low cost.

15 Claims, 20 Drawing Sheets

(A)

(B)

(A)

(B)

(A)

(B)

(A)

(B)

(A)

RESONATOR, FILTER, DUPLEXER, AND COMMUNICATION APPARATUS

CROSS REFERENCE TO RELATED APPLICATIONS

The present application is a continuation of PCT Appln. No.: PCT/JP02/13181, filed Dec. 17, 2002, and entitled: RESONATOR, FILTER, DUPLEXER, AND COMMUNICATION APPARATUS, the entire contents of which are incorporated herein by reference.

TECHNICAL FIELD

The present invention relates to a resonator, a filter, a duplexer, and a communication apparatus for use in wireless communication or transmission/reception of electromagnetic waves in, for example, a microwave or millimeter-wave band.

BACKGROUND ART

As a resonator used in the microwave or millimeter-wave band, a hairpin resonator disclosed in Japanese Unexamined Patent Application Publication No. 62-193302 is known. The hairpin resonator has an advantage that it can be formed to be smaller than resonators using a linearly-extending conductor line.

A planar-circuit-type multiple C-ring resonator formed by means of a thin-film micro-fabrication technique is disclosed in Japanese Unexamined Patent Application Publication No. 2000-49512. The multiple C-ring resonator has an advantage that it has a higher conductor Q-factor than the hairpin resonator disclosed in Japanese Unexamined Patent Application Publication No. 62-193302.

A planar-circuit-type multiple spiral resonator formed by means of a thin-film micro-fabrication technique is disclosed in Japanese Unexamined Patent Application Publication No. 2000-244213. In this type of resonator, currents flowing through respective conductor lines are similar, in distribution, to each other, and thus a further higher conductor Q-factor can be obtained than can be obtained by the hairpin resonator.

Although the multiple spiral resonator disclosed in Japanese Unexamined Patent Application Publication No. 2000-244213 has the advantage that it has high conductor Q-factor, a disadvantage is that it needs high cost to produce it by means of a thin-film micro-fabrication process. When it is required to reduce the size of the resonator, finer fabrication is required, and the production cost is accordingly increased.

Accordingly, it is an object of the present invention to provide a resonator, a filter, a duplexer, and a communication apparatus, which have a small size and a high conductor Q-factor and which can be produced at reasonably low cost.

DISCLOSURE OF THE INVENTION

In order to achieve the above objects, the present invention provides a resonator comprising one or more ring-shaped resonant elements, each resonant element including one or more conductor lines, each resonant element having a capacitive part and an inductive part, the capacitive part being formed by locating ends portions of conductor lines such that one end portion of a conductor line and the other end portion of the same conductor line closely adjoin each other in a width direction or such that one end portion of a conductor line and an end portion of another conductor line included in the same resonant element closely adjoin each other in a width direction.

In this structure, capacitive parts functions as capacitance, and each conductor line functions as a half-wave transmission line whose both ends are electrically open. It is not necessary to form a ground electrode on a surface of a substrate opposite to a surface on which the conductor lines are formed. Thus, a resonator having a desired conductor Q-factor and having a simple structure including a very small number of constituent elements can be produced at low cost.

In this resonator according to the present invention, the resonant element may include a plurality of conductor lines and a plurality of capacitive parts.

In the resonator according to the present invention, the conductor lines may be formed on a plane-shaped substrate. In this structure, it is not necessary to form a ground electrode on a surface of the substrate opposite to the surface on which the conductor lines are formed. This makes it possible to produce the resonator using a very small number of constituent elements at low cost. By forming the conductor lines such that end portions of each conductor line closely adjoin each other in a width direction, it becomes possible to obtain greater capacitance than can be obtained by a structure in which ends of each conductor line closely adjoin each other in a longitudinal direction. This allows a reduction in the size of the resonator.

In the resonator according to the present invention, the substrate member may be formed in the shape of a solid cylinder or a hollow cylinder, and conductor lines may be formed around a side face of the substrate member. This makes it possible to apply the invention to a cylindrical structure.

End portions of a conductor line may be located in close proximity to each other such that the end portions form an interdigital transducer. This allows a reduction in the length of end portions, closely adjoining in the width direction, of the conductor lines and thus a reduction in the total size of the resonator.

In the resonator according to the present invention, the width of some or all conductor lines and the space between some or all adjacent conductor lines may be set to be equal to or smaller than the skin depth of the conductor. This allows a reduction in current concentration due to the skin effect and the edge effect, and thus an increase in the conductor Q-factor of the resonator is achieved.

In the resonator according to the present invention, the space between conductor lines adjoining each other in a width direction may be set to be equal to or smaller than the skin dept of the conductor lines. This allows a reduction in current concentration due to the edge effect, and thus an increase in the conductor Q-factor of the resonator is achieved.

In the resonator according to the present invention, the space between conductor lines adjoining each other in the width direction may be set to be substantially constant. This makes is possible to form all conductor lines using a micro-fabrication process under the same condition adapted to forming the smallest pattern, thereby allowing a resonator having high conductor Q-factor to be produced in a highly efficient manner.

In the resonator according to the present invention, the conductor lines may be produced in the form of a thin-film multilayer electrode obtained by alternately forming dielectric thin-film layers and conductive thin-film layer one on another. This allows not only a reduction in the current concentration in the width direction of the conductor lines due to the edge effect but also a reduction in the current concentration due to in the thickness direction of the conductor lines due to the skin effect. Thus, it is possible to further increase the conductor Q-factor of the resonator.

In the resonator according to the present invention, the space between conductor lines adjoining each other in a width direction may be filled with a dielectric material. This results in an increase in capacitance formed between adjacent conductor lines of the resonator, and thus it becomes possible to reduce the length of end portions, closely adjoining in the width direction, of the conductor lines and thus it is possible to reduce the size of the resonator.

The present invention also provides a filter including a resonator constructed in one of the forms described above and signal input/output means which is formed on the same substrate as that on which the resonator is formed and which is coupled with the resonator. This resonator can be produced in a small form and can have a low insertion loss.

The present invention also provides a duplexer including the filter described above which is used as a transmitting filter or a receiving filter or used as both a transmitting filter and a receiving filter. This duplexer has an advantage that it has a low insertion loss.

The present invention also provides a communication apparatus including at least the filter or the duplexer descried above. This communication apparatus has an advantage that it has a low insertion loss in RF transmitting and receiving circuits and has high transmission performance in terms of, for example, noise characteristic and transmission rate.

BEST MODE FOR CARRYING OUT THE INVENTION

A resonator, a filter, a duplexer, and a communication apparatus according to the present invention are described below with reference to preferred embodiments in conjunction with the accompanying drawings.

First Embodiment

Figure 1:
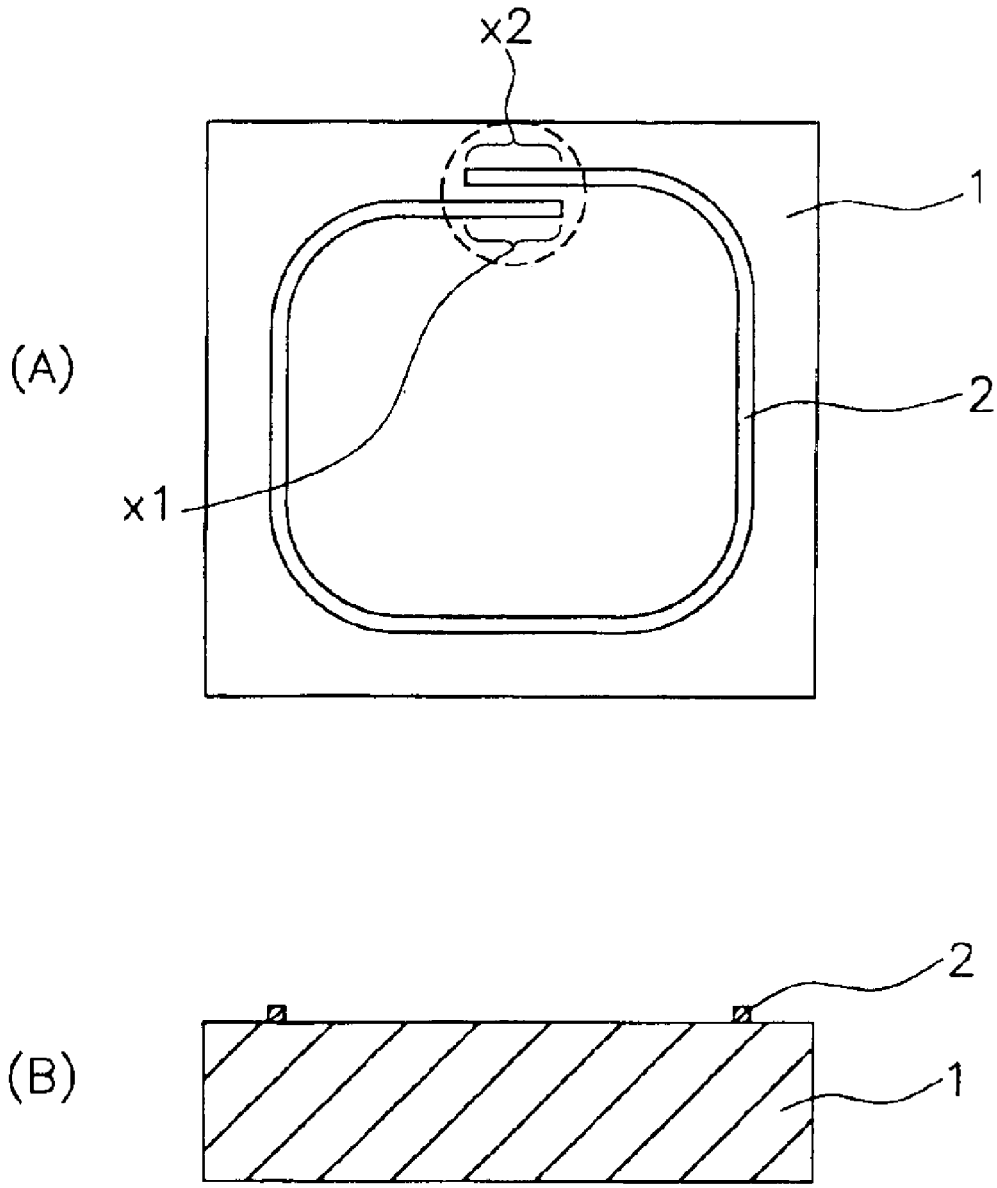
FIG. 1 is a diagram showing a construction of a resonator according to a first embodiment of the present invention.

FIG. 1 illustrates the configuration of a resonator according to a first embodiment of the present invention, and more specifically, FIG. 1(A) is a top view of the resonator, and FIG. 1(B) is a cross-sectional view thereof.

As shown in FIG. 1, the resonator includes a dielectric substrate (hereinafter, referred to simply as a substrate) 1 and a conductor line 2 formed on the upper surface of the substrate 1. No ground electrode is formed on a surface (lower surface) of the substrate 1 opposite to the surface on which the conductor line 2 is formed. The conductor line 2 has a constant width and extends along a full one turn of circumferential length of a ring. The conductor line 2 has two end portions which additionally extend and which are located such that they closely adjoin each other in a width direction. More specifically, in an area enclosed in a circle in FIG. 1(A), one end portion x1 of the conductor line and the other end portion x2 closely adjoin each other in the width direction.

Figure 2:
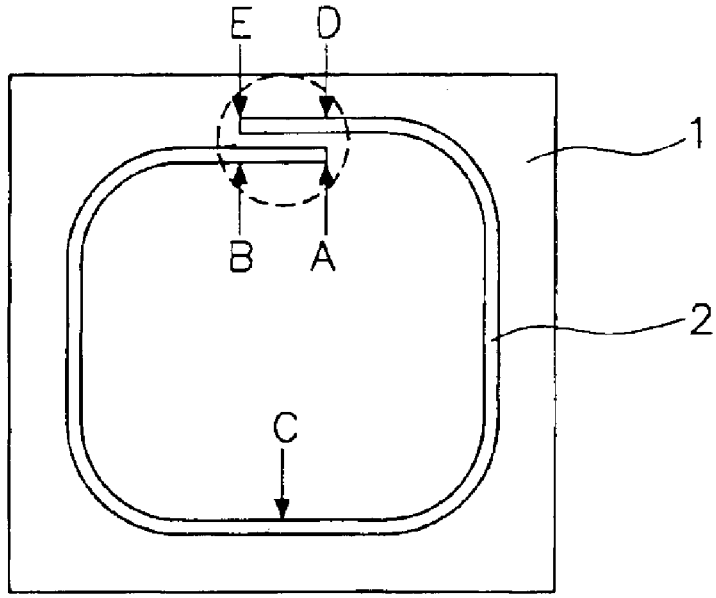
FIG. 2 is a diagram showing an electric field distribution in areas near two ends of a conductor line of the resonator shown in FIG. 1 and also showing a distribution of current flowing through the conductor line.
Figure 2:
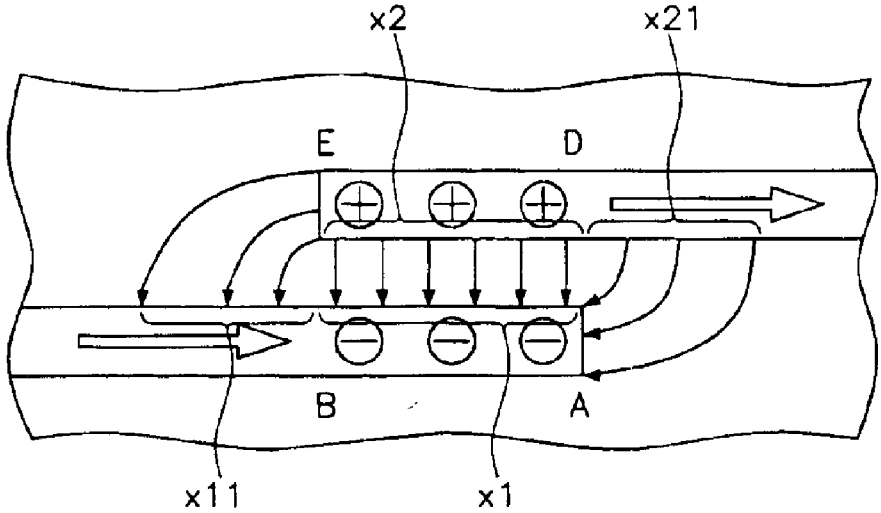

FIG. 2 illustrates the operation of the above-described resonator, and more specifically, FIG. 2(A) illustrates four positions A, B, D, and E at which the end portions of the conductor line are located in close proximity to each other, and also illustrates a longitudinal center position C of the conductor line, FIG. 2(B) illustrates an electric field distribution in an area in which the two end portions of the conductor line are located in close proximity to each other, and FIG. 2(C) illustrates the current distribution along the conductor line.

As can be seen from FIG. 2(B), the electric filed has very high intensity in the area in which the two end portions x1 and x2 of the conductor line closely adjoin each other in the width direction, compared with the intensity in the other area. Furthermore, the intensity of the electric field is also high in an area between one end of the conductor line and a portion x11 immediately adjacent to the end portion x1 at the opposite end of the conductor line, and also in an area between the other end of the conductor line and a portion x21 immediately adjacent to the end portion x1 of the conductor line. Capacitance is formed in those areas in which the electric field becomes high in intensity.

As shown in FIG. 2(C), the current intensity changes such that it abruptly increases in the area from position A to position B and has a substantially constant value in the area from position B to position D. In the area from position D to position E, the current intensity abruptly decreases. The current intensity becomes 0 at both ends. Thus, a part of the conductor line in the area from A to B and a part in the area from D to E, in which the two end portions of the conductor line closely adjoin each other in the width direction, function as capacitive parts, while the remaining part in the area B to D functions as an inductive part. Resonance can occur as a result of cooperation between the capacitive parts and the inductive part. In analogy to a lumped-constant circuit, the resonator can be regarded as having the form of an LC resonant circuit.

Hereinafter, the above-described ring-shaped element formed of the conductor line including the capacitive parts and the inductive part will be referred to as a resonant element.

Second Embodiment

Figure 3:
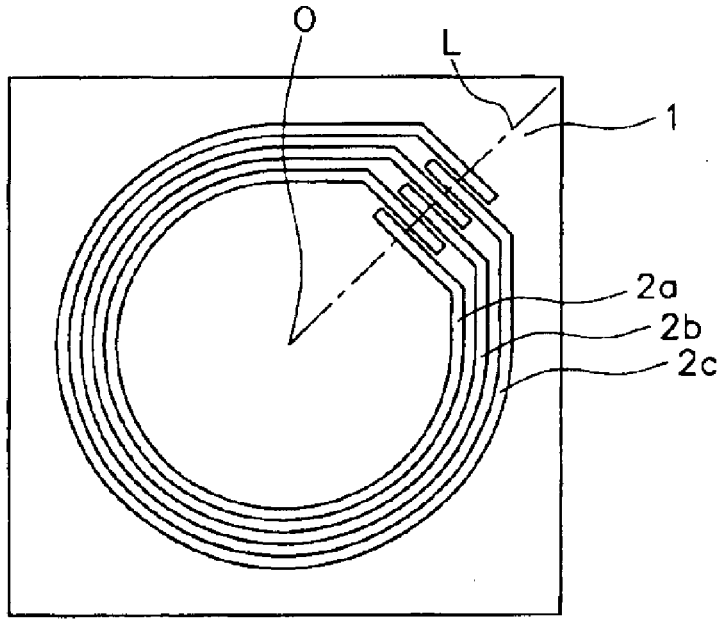
FIG. 3 is a diagram showing a construction of a resonator according to a second embodiment of the present invention.
Figure 3:
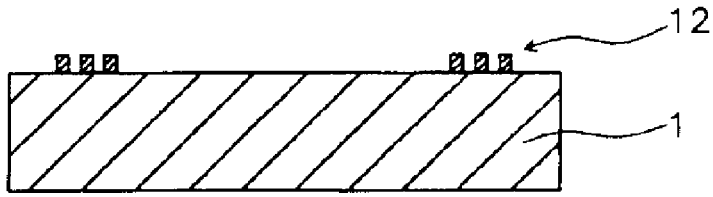

FIG. 3 illustrates the configuration of a resonator according to a second embodiment of the present invention, and more specifically, FIG. 3(A) is a top view of the resonator, and FIG. 3(B) is a cross-sectional view thereof.

In this resonator shown in FIG. 3, unlike the resonator shown in FIG. 1 in which the resonator is realized by forming a single conductor line 2 on a substrate 1, the resonator is formed of a set of conductor lines 12 including three conductor lines 2*a*, 2*b*, and 2*c* on the upper surface of a substrate 1. No ground electrode is formed on the lower surface of the substrate 1.

That is, according to the present embodiment, a resonator can be constructed by forming only conductor lines on a substrate without having to forming a ground electrode on a surface opposite to a surface on which the conductor lines are formed. As a matter of course, a ground electrode may be formed on the surface of the substrate opposite to the surface on which the conductor lines are formed. If a ground electrode is formed, it serves as a shield against and electromagnetic field. This makes it possible to realize a simple shielding structure in a resonator.

Also in embodiments described below, no ground electrode is formed on the lower surface of the substrate. In each conductor line, two end portions thereof are located so as to closely adjoin each other in a width direction thereby forming a capacitive part at the ends of the conductor line. Thus, each of three conductor lines 2*a*, 2*b*, and 2*c* forms a resonant element. Those three conductor lines 2*a*, 2*b*, and 2*c* are located substantially concentrically about a particular point O on the substrate 1 such that the three conductor lines 2*a*, 2*b*, and 2*c* do not intersect with each other. One resonator is formed by the three resonant elements of respective conductor lines 2*a*, 2*b*, and 2*c*.

Although adjacent conductor lines are located in close proximity to each other, substantially no capacitance is formed between adjacent conductor lines in areas in which inductive parts are formed excluding areas in which capacitive parts are formed. This is because positive and negative charges are present only in end portions (capacitive parts) and substantially no charges are present in inductive parts, as shown in FIG. 2(B). Absence of charges causes no displacement current to flow between adjacent conductor lines. Therefore, the capacitive parts and the inductive parts can correctly function even when a resonator includes a plurality of resonant elements.

In the present example, the capacitive parts (in an area enclosed in a circle in the figure) of the conductor lines 2*a*, 2*b*, and 2*c* are formed such that they are located in close proximity to each other and they extend across a line L passing through the center O of the ring formed by the conductor lines.

The advantages obtained by the resonator of the second embodiment are as follows.

(1) Each conductor line functions as a half-wave transmission line whose both ends are electrically open. In the present example, each conductor line forms one resonant element.

(2) A positive charge is generated in one end portion of each conductor line and a negative charge is generated in the opposite end portion of the conductor line, and thus capacitor is formed in the area in which the two end portions of each conductor line are located in close proximity to each other.

(3) Because capacitance is formed in a single plane, resonance can be achieved without having to form a ground electrode on the back surface (lower surface) of the substrate.

(4) The intensity of the current flowing through conductor lines is determined by the capacitance of the respective conductor lines.

(5) The current flowing through each conductor line induces a magnetic field distributed in a similar manner to that in a circular TE01δ mode. More specifically, the magnetic field extends along a circumferential path in the rz plane in a symmetrical fashion about an axis.

(6) The total current is distributed among the plurality of conductor lines such that distributed currents flowing through adjacent conductor lines are substantially equal in phase. As a result of distribution of the current among conductor lines, the high current intensity in the end portions and in neighboring areas is reduced, and thus the conductor Q-factor is improved.

(7) Because capacitive parts of the respective resonant elements are located in close proximity to each other, the capacitance of the resonator is lumped in a particular local region on the plurality of conductor lines, the capacitive parts and the inductive parts can fulfill assigned functions. This makes it easy to design a connection between the resonator and another circuit which uses the resonator.

Third Embodiment

Figure 4:
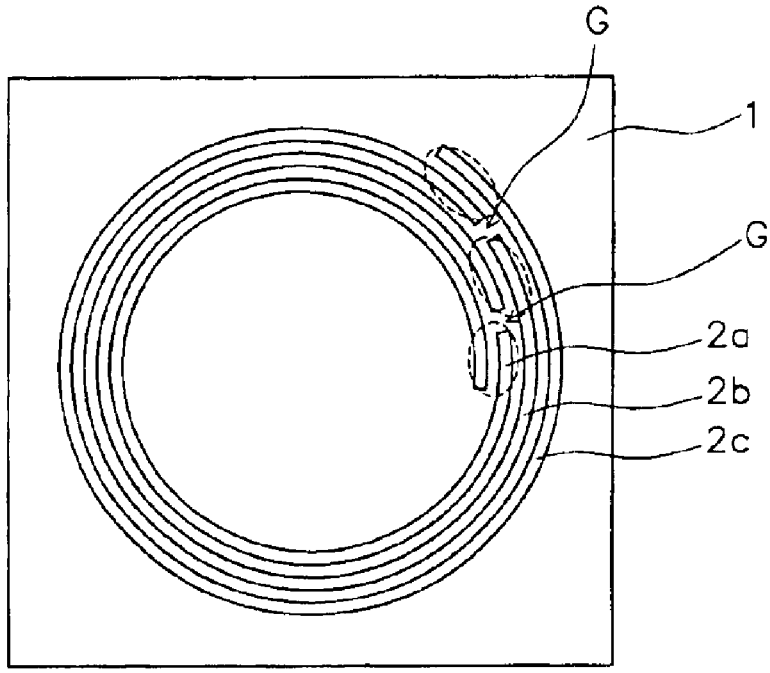
FIG. 4 is a diagram showing a construction of a resonator according to a third embodiment of the present invention.
Figure 4:
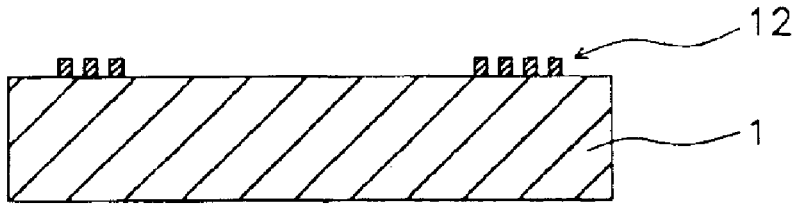

FIG. 4 illustrates the configuration of a resonator according to a third embodiment of the present invention, and more specifically, FIG. 4(A) is a top view of the resonator, and FIG. 4(B) is a cross-sectional view thereof.

In this third embodiment, two end portions of each of conductor lines 2*a*, 2*b*, and 2*c* are located so as to closely adjoin each other in a width direction, wherein, at a position denoted by G in FIG. 4(A), one end of each of conductor lines 2*a*, 2*b*, and 2*c* face one end of another adjacent conductor line via a gap with a particular gap distance. This pattern is equivalent to a pattern obtained by partially cutting a spiral-shaped conductor line at particular positions (denoted by G in FIG. 4(A)). More specifically, the location of the capacitive part (formed in an area enclosed in an ellipse in FIG. 4(A)) of each resonant element is slightly shifted in a circumferential direction relative to the location of the capacitive part of an adjacent resonant element. In other words, when the change in location is seen in a radial direction, the locations of capacitive parts shift in a circumferential direction with changing radial position of the resonant element.

The structure described above allows a conductor line set 12 including many lines to be disposed in a limited area, and thus it is possible to reduce the total size of the resonator.

Furthermore, the space between adjacent conductor lines is maintained at a small fixed value along the entire length of conductor lines, the local increase in current due to the edge effect can be minimized along the entire length of conductor lines, and thus the conductor Q-factor is improved.

Analytical comparison between the resonator including a plurality of resonant elements according to the third embodiment and the comparative example of multiple spiral resonator is described below. In the third embodiment, each resonant element includes an inductive part having a high impedance and a capacitive part having a low impedance, in which the impedance changes abruptly in a step fashion. Thus, hereinafter, each resonant element is referred to as a step ring, and a resonator including a plurality of resonant elements is referred to as a multiple step ring resonator.

Figure 5:
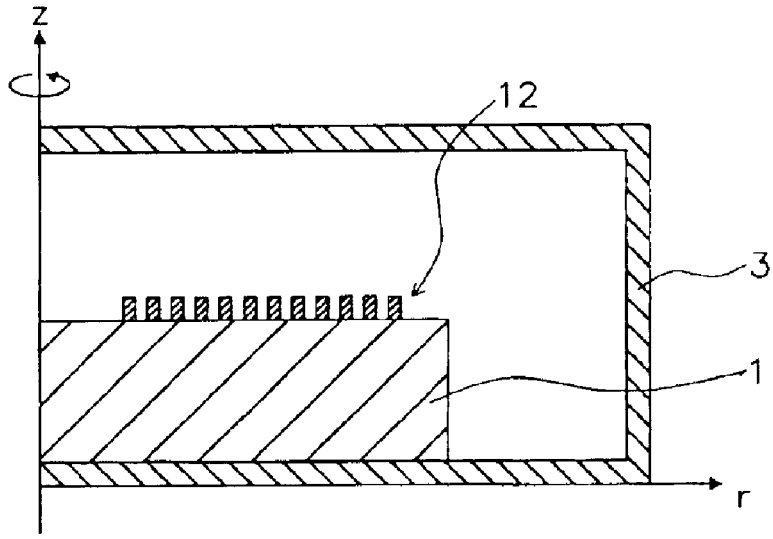
FIG. 5 is a diagram showing a current distribution in the resonator according to the third embodiment of the present invention.

FIG. 5(A) is a view showing one side of cross section, in the rz plane, of the resonator shown in FIG. 4. The set of conductor lines 12 is formed on the upper surface of the substrate 1, and the substrate 1 and the set of conductor lines 12 formed thereon are enclosed in a shielding cavity 3. The physical dimensions of the conductor line 2 are listed below.

internal radius ra=250 $\mu$m;

external radius rb=1000 $\mu$m;

width of conductor line Lo=1.5 $\mu$m;

space between adjacent conductor lines So=1.5 $\mu$m;

line thickness t=5 $\mu$m number of lines n=250

FIG. 5(B) illustrates the current distribution in a radial direction of conductor lines. In FIG. 5(B), (1) indicates the current distribution in the multiple step ring resonator, and (2) indicates the current distribution in the multiple spiral resonator including a set of conductor lines disposed in the form of a spiral, disclosed in Japanese Unexamined Patent Application Publication No. 2000-244213.

Currents are forced into respective conductor lines as described below.

(1) In the multiple step ring resonator, currents are forced into conductor lines as follows:

current sequence ik=4 [mA]total current I=1 [A]

(2) In the multiple spiral resonator, currents are forced into conductor lines as follows:

current sequence (see FIG. 5(B))

maximum value=approximately 8 [mA]

minimum value=0 [A]

average=4 [mA]

total current I=1 [A]

In the case of the multiple step ring resonator, as described above in (1) and as can be seen from FIG. 5(B), currents equally flow through all the conductor lines. In contrast, in the case of the multiple spiral resonator, as described above in (2), the currents flowing through conductor lines change depending on their location in a radial direction in such a manner that the current increases from 0 at one end in the radial direction to a peak value at a location slightly shifted outward in the radial direction from the center location, and the current decreases from the peak value to 0 at the opposite end. In the multiple step ring resonator, currents equally flow through all conductor lines as described above, and thus the overall conductor loss of the set of conductor lines can be minimized. As a result, a resonator having a high conductor Q-factor can be realized.

The conductor Q-factor, the magnetic energy, and the inductance of the above-described resonator can be calculated as described below.

The magnetic stored energy Wm is given by $$Wm=LI^2/2,$$

and the total current (effective value) I is given by $$I=\Sigma i_k \ (k=1 \text{ to } n).$$

From the above two equations, the inductance L of the resonator is given as $$L=2Wm/I^2$$

Herein, if the conductor Q-factor is denoted as Qc, Qc and other parameters described above can be calculated for the respective resonator as follows.

(1) Calculated values for the multiple step ring resonator

Qc=250;

Wm=1.96 nJ

L=0.98 nH (2) Calculated values for the multiple spiral resonator

Qc=219;

Wm=3.17 nJ

L=1.58 nH

On the basis of the above calculation, the physical dimensions of the capacitive part of the multiple step ring resonator can be designed as follows.

For example, in a case in which the resonator is designed so as to have a resonant frequency of 2 GHz, capacitance must be equal to 6.45 pF for the value of inductance 0.98 nH. If the effective relative dielectric constant of the 1.5 $\mu$m gap between conductor lines is assumed to be 40, the capacitive part must have a total length of 5.47 mm to obtain capacitance of 6.45 pF. If the total capacitance of 6.45 pF is equally distributed among 250 step rings, the length Wg of each capacitive part is set to be 5.47 mm/250=21.9 $\mu$m.

Fourth Embodiment

Figure 6:
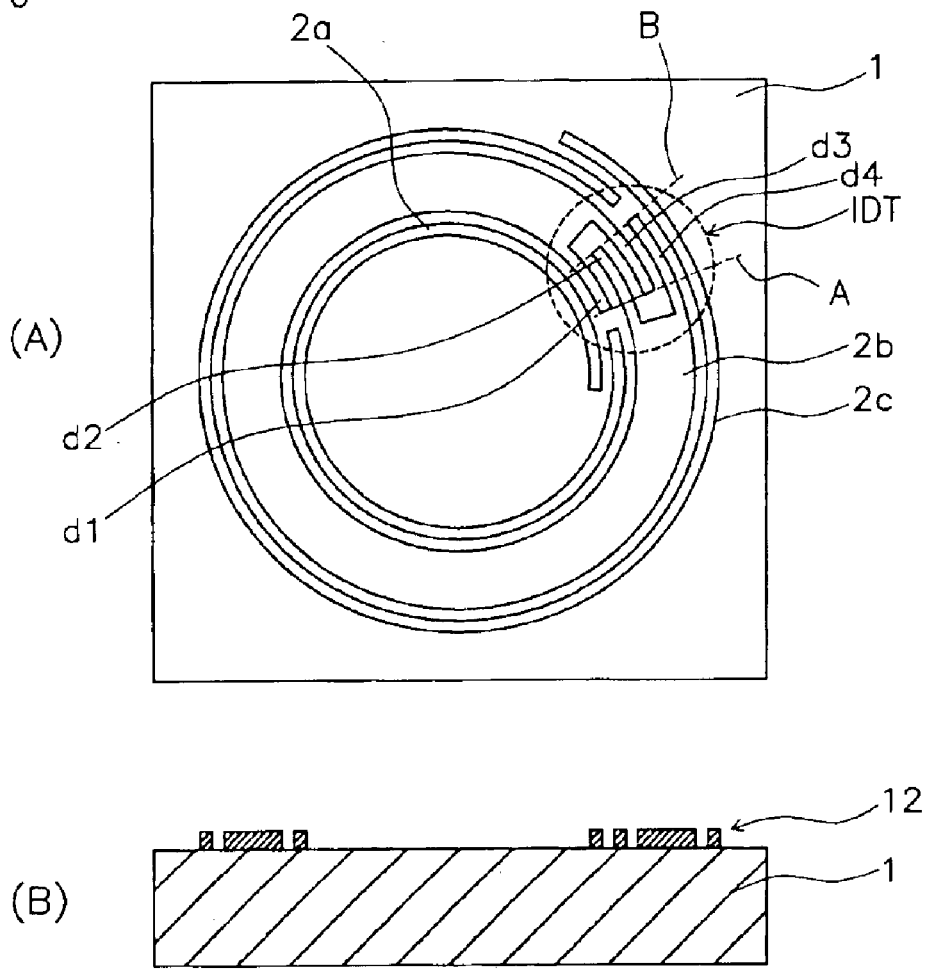
FIG. 6 is a diagram showing a construction of a resonator according to a fourth embodiment of the present invention.

FIG. 6 is a diagram showing a construction of a resonator according to a fourth embodiment of the present invention.

In this resonator according to the fourth embodiment, as in the resonator shown in FIG. 4, each of three conductor lines 2*a*, 2*b*, and 2*c* forms a resonant element. However, in the conductor line 2*b*, end portions d1, d2, d3, and d4 are located so as to adjoin each other in a width direction in an area enclosed in a circuit shown in FIG. 6. That is, those end portions form an interdigital transducer (IDT) in which two comb-shaped end portions interdigitally engage with each other.

Use of such a IDT structure makes it possible to obtain high capacitance in a limited area. Thus, it is possible to achieve a desired resonant frequency with a reduced conductor line length. That is, it is possible to reduce the total area in which the set of conductor lines 12 is formed thereby allowing a reduction in the total size of the resonator. Furthermore, because the space between adjacent resonant elements is maintained at a fixed value, the current concentration due to the edge effect is eased over the entire length of the conductor lines, and thus an increase in conductor Q-factor is achieved.

Furthermore, because the conductor line 2*b* located at the center in the width direction in the set of conductor lines (a central conductor line of three conductor lines, in a case in which there are three conductor lines) has a width greater than the width of conductor lines 2*a* and 2*c* located at innermost and outmost positions, the current concentration due to the edge effect can be efficiently suppressed in particular in areas where a high current concentration would otherwise occur.

Fifth Embodiment

Figure 7:
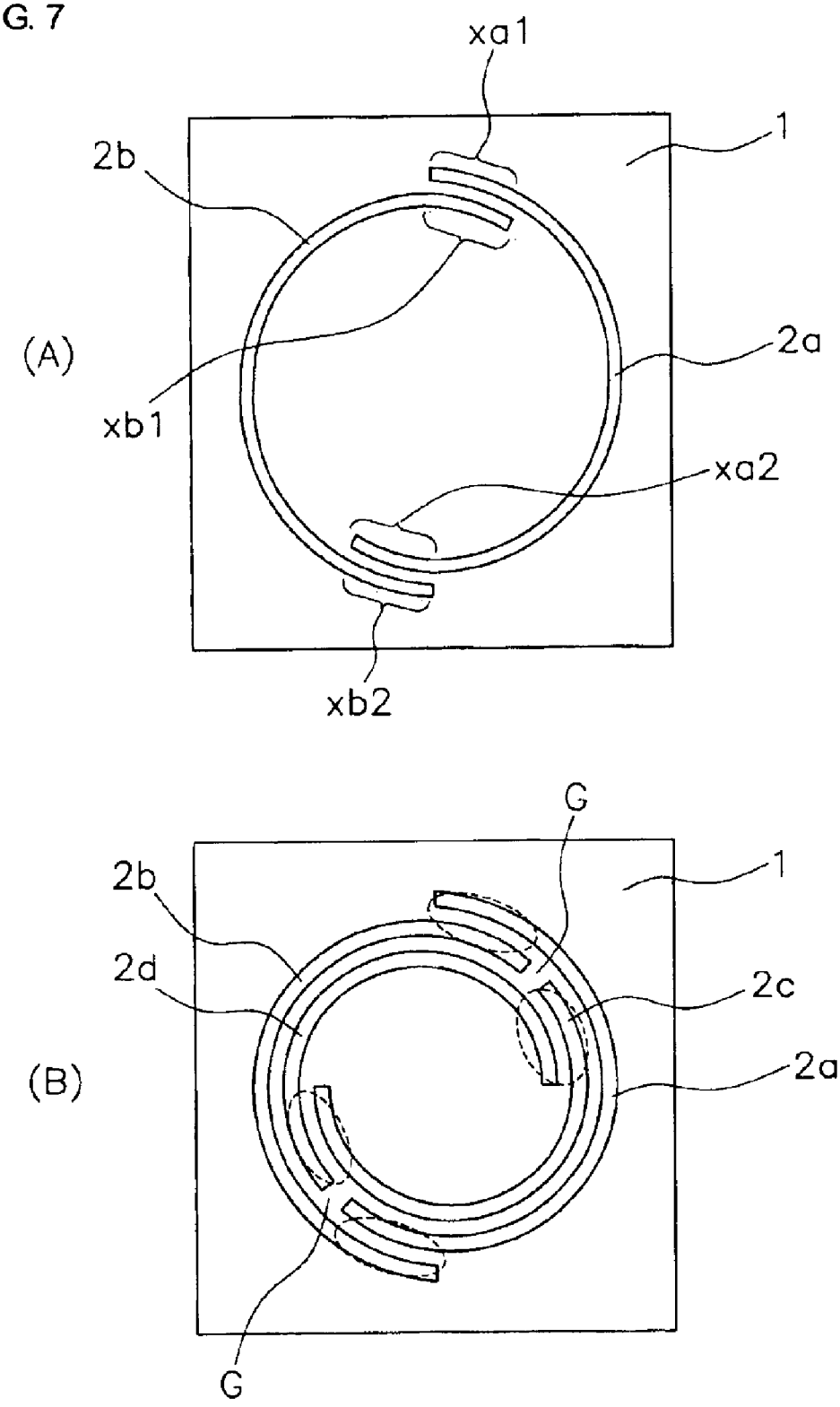
FIG. 7 is a diagram showing a construction of a resonator according to a fifth embodiment of the present invention.

Now, referring to FIGS. 7 to 9, a resonator according to a fifth embodiment is described below.

Although in the first to fourth embodiments described above, each resonant element is formed in the shape of a ring using a single conductor line, it is not necessarily required that each resonant element include a single conductor line, but each resonant element may include a plurality of conductor lines. That is, one resonant element may include a plurality of capacitive parts and a plurality of inductive parts. For example, as shown in FIG. 7, a resonant element may be formed into the shape of a ring using two conductor lines. In the example shown in FIG. 7(A), two conductor lines 2*a* and 2*b* each having the shape of a partial ring whose length is slightly greater than one-half of the length of a full ring are formed on a dielectric substrate 1. Alternatively, a resonant element may be formed of three conductor lines each having the shape of a partial ring with a length slightly greater than one-third of the length of a full ring. In this case, three capacitive parts are formed within the full ring length.

In the example shown in FIG. 7(A), one end portion xa1 of the conductor line 2*a* and one end portion xb1 of the conductor line 2*b* are located so as to closely adjoin each other in a width direction. Similarly, the other end portion xa2 of the conductor line 2*a* and the other end portion xb2 of the conductor line 2*b* are located so as to closely adjoin each other in a width direction. Two capacitive parts are formed in respective areas in which the two sets of end portions adjoin. Thus, each of the conductor lines 2*a* and 2*b* functions as a half-wave transmission line whose both ends are electrically open.

FIG. 7(B) shows an example of a resonator formed of two resonant elements shown in FIG. 7(A). Two end portions of the conductor line 2*a* and two end portions of the conductor line 2*b* are located so as to closely adjoin each other thereby forming two capacitive parts. Similarly, two end portions of the conductor line 2*c* and two end portions of the conductor line 2*d* are located so as to closely adjoin each other thereby forming two capacitive parts. Thus, capacitive parts are formed in four areas each enclosed in an ellipse in FIG. 7(B). In this structure, the conductor lines 2*a*, 2*b*, 2*c*, and 2*d* are disposed such that one end of a conductor line of each resonant element and one end of a conductor line of another adjacent resonant element face with each other via a gap with a particular gap distance at a position denoted by G. The space between adjacent resonant elements is maintained at a fixed value. Therefore, as in the embodiment shown in FIG. 4, the current concentration due to the edge effect is eased over the entire length of the conductor lines, and an increase in conductor Q-factor is achieved.

Figure 8:
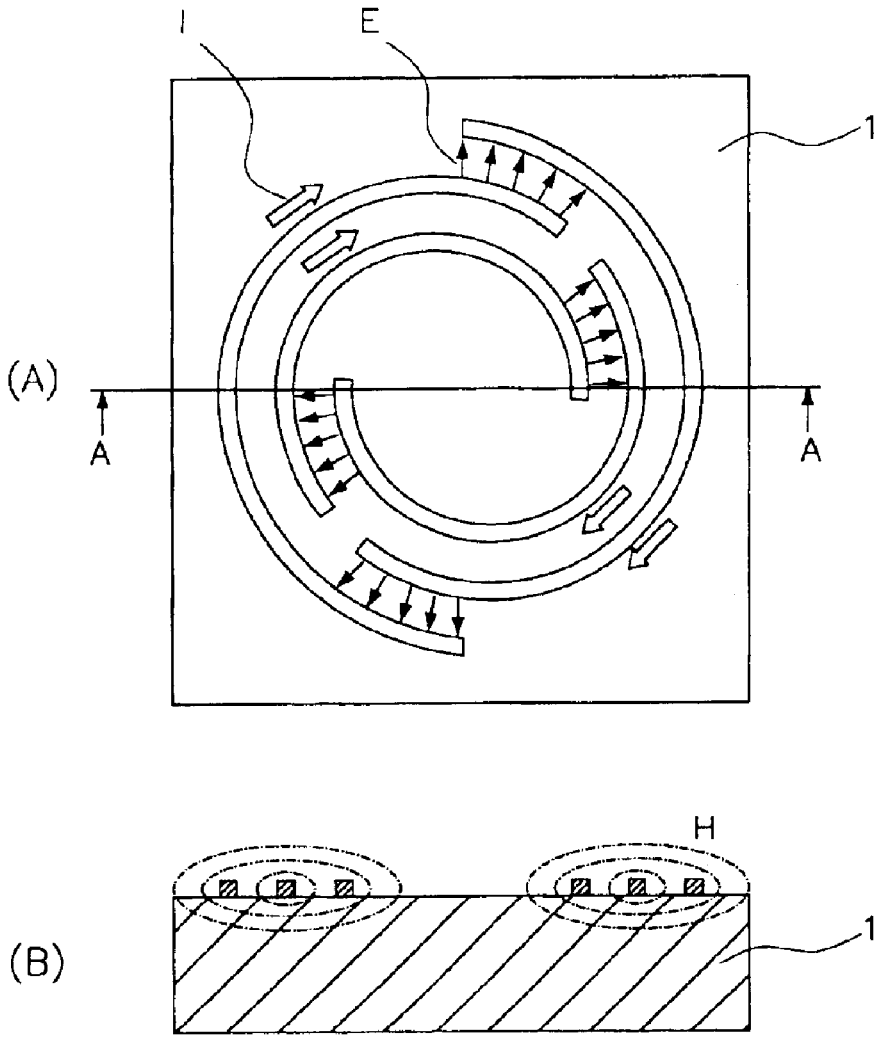
FIG. 8 is a diagram showing an example of an electric field distribution and a direction of a current in the resonator according to the fifth embodiment.

FIG. 8 shows the operation of the resonator shown in FIG. 7(B), wherein FIG. 8(A) shows an example of an electric field distribution between adjacent conductor lines and directions in which currents flow through respective conductor lines, and FIG. 8(B) shows a magnetic field distribution in cross section taken along line A—A in FIG. 8(A). In FIGS. 8(A) and 8(B), E, H, and I denote the electric field, the magnetic field, and the current, respectively.

As shown in FIGS. 8(A) and 8(B), the electric field concentrates in areas in which end portions of conductor lines closely adjoin each other in a width direction of conductor lines. This means that capacitive parts are formed in the areas in which end portions of conductor lines closely adjoin each other in the width direction of conductor lines, and the other parts of the conductor line, through which currents flow, function as inductive parts.

Figure 9:
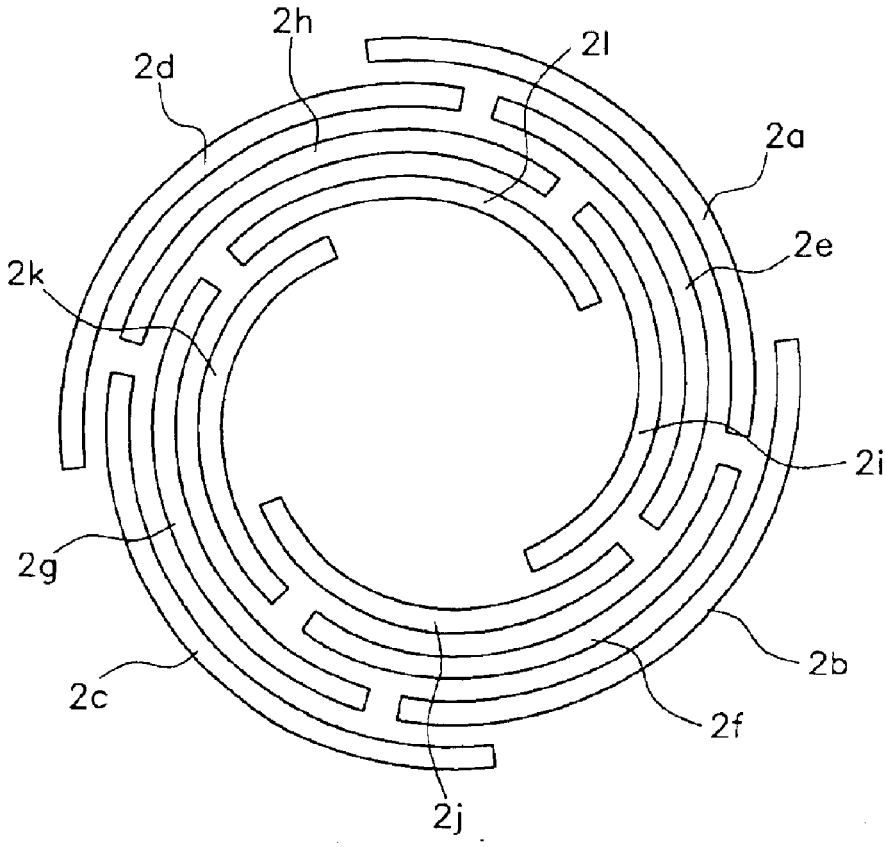
FIG. 9 is a diagram showing another example of a pattern of conductor lines of the resonator according to the fifth embodiment of the present invention.

FIG. 9 shows an example in which three sets of resonant elements each including four conductor lines. In FIG. 9, four conductor lines 2*a*, 2*b*, 2*c*, and 2*d* form a first resonant element, four conductor lines 2*e*, 2*f*, 2*g*, and 2*h* form a second resonant element, and four conductor lines 2*i*, 2*j*, 2*k*, and 2*l* form a third resonant element.

In the resonator having the structure shown in FIG. 9, like the structure in which each conductor line is composed of a full one-turn ring and further extending two end portions, capacitive parts function in a more similar manner to lumped-constant capacitance as the relative length in the circumferential direction of capacitive parts decreases, and neither nodes nor antinodes appear in distribution of currents flowing through the other portions serving as inductive parts of the conductor lines. Current flow through all conductor lines in the same circumferential direction. Mutual induction among magnetic vectors induced by the respective currents allows magnetic energy to be stored in an efficient manner.

Because currents are distributed among conductor lines, the current concentration due to the edge effect, which occurs in microstrip lines, is eased, and thus the conductor loss is reduced.

Furthermore, advantages described below are obtained by locating a plurality of capacitive parts along a circumferential direction of each conductor line.

That is, when high-frequency circuits for use at higher frequencies in the millimeter-wave band are designed, the lengths of end portions functioning as capacitive parts of conductor lines are reduced while maintaining a given particular size of a resonator formed on a substrate (wherein the size of the resonator may be expressed by the diameter of the substantially circular area in which the resonator is formed or by the area occupied by the resonator). In the design of such high-frequency circuits, the accuracy required in micro fabrication processes to produce resonators becomes more severe with increasing frequency. In the present embodiment, the above problem can be avoided as described below. That is, an one-turn-ring conductor line is divided into a plurality of conductor lines. As a result, a capacitive part of the original one-turn-ring conductor line is also divided into a plurality of capacitive parts. That is, a plurality of capacitive parts are formed within one full turn of a ring, and the effective capacitance of the overall conductor line is given by a series connection of capacitance of the plurality of capacitive parts. Thus it becomes possible to increase the capacitance per capacitive part while maintaining the effective capacitance at a desired value.

For example, when a capacitive part is divided into two parts (that is, when a resonant element is formed of two conductor lines located along a full one turn of a ring such that resonant element includes two capacitive parts), the effective capacitance C of a series connection of capacitive parts with capacitance C1 and C2 is given by $$C=1/(1/C1+1/C2)$$

In a case in which a capacitive part is divided into three capacitive parts with capacitance C1, C2, and C3, the effective capacitance C for a series connection thereof is given by $$C=1/(1/C1+1/C2+1/C3)$$

Sixth Embodiment

Figure 10:
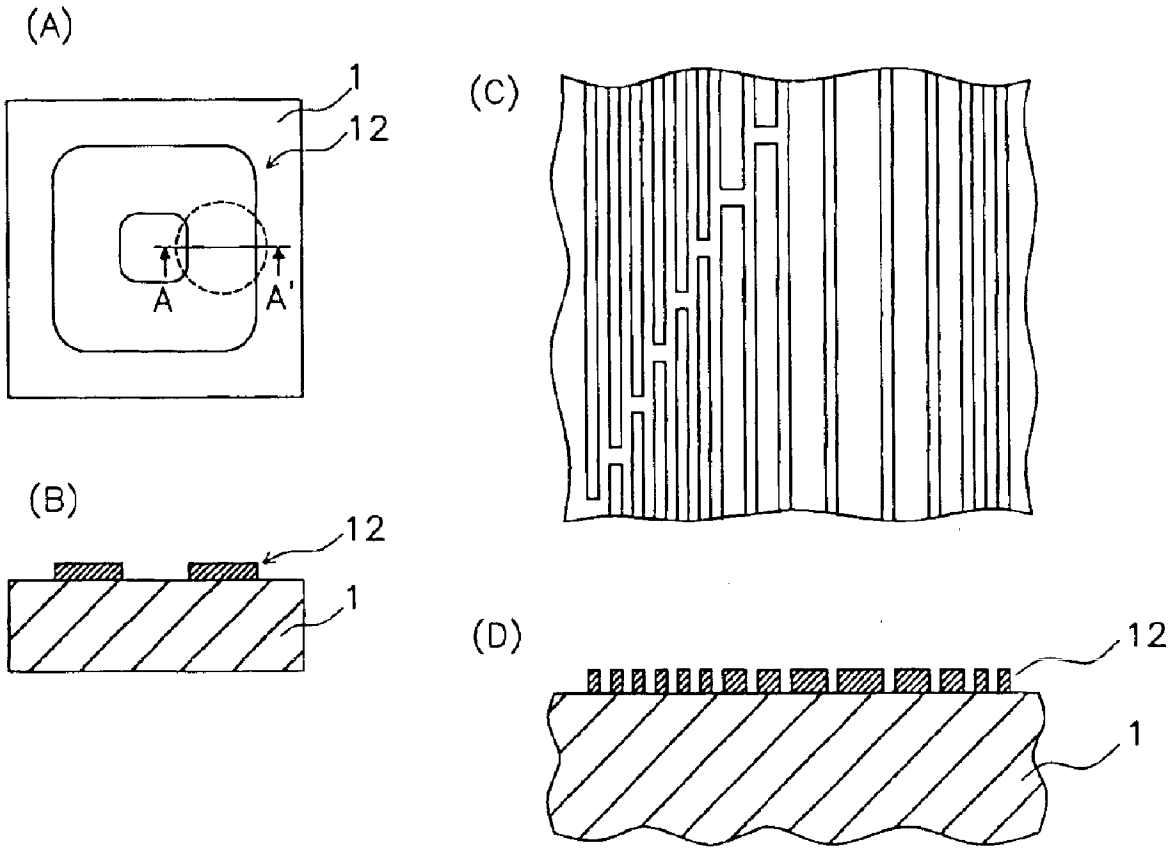
FIG. 10 is a diagram showing a construction of a resonator according to a sixth embodiment of the present invention.
Figure 11:
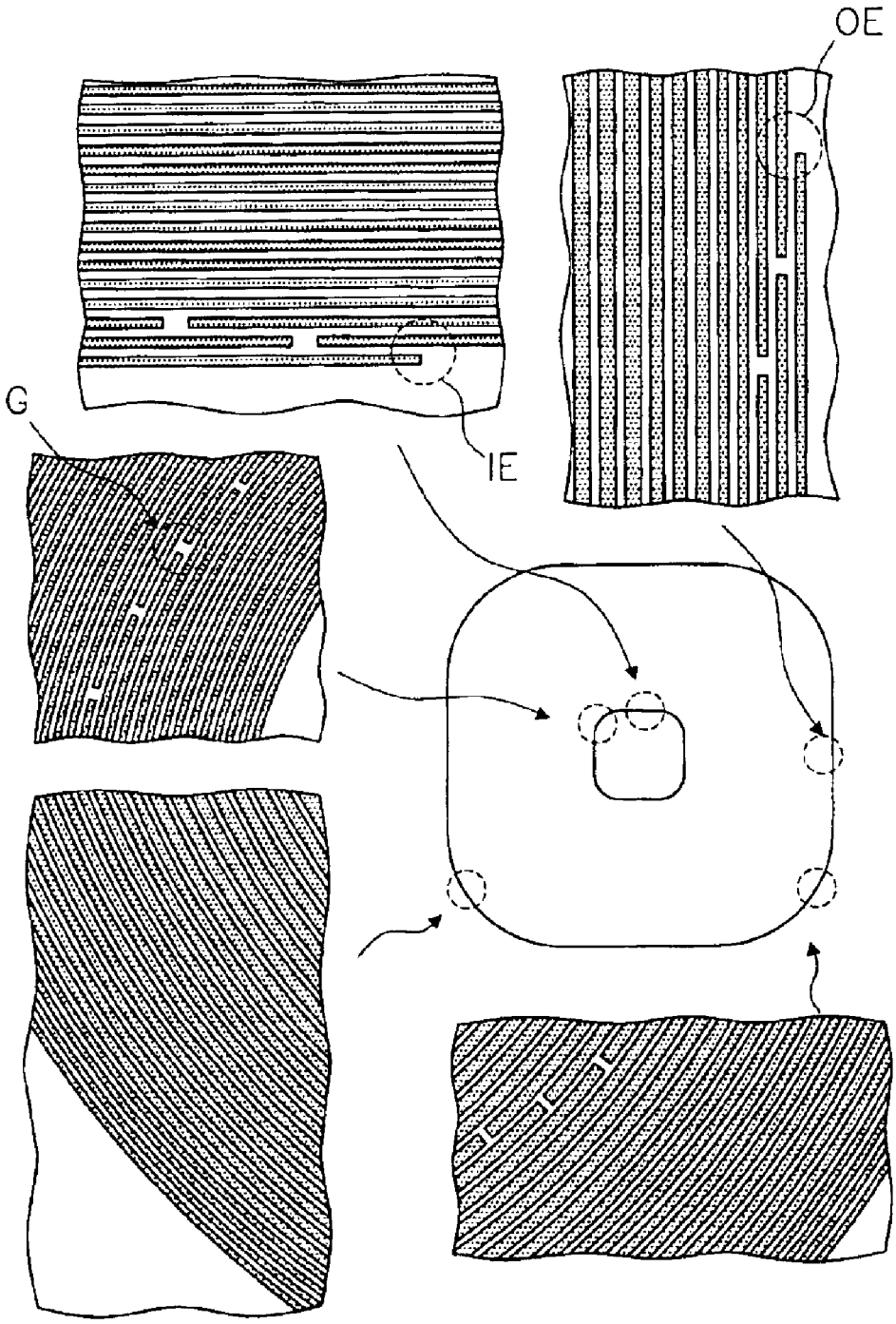
FIG. 11 shows, in an enlarged fashion, various parts of the resonator according to a sixth embodiment of the present invention.

Referring to FIGS. 10 and 11, a resonator according to a sixth embodiment is described below. FIG. 10(A) is a top view of the resonator according to the sixth embodiment, FIG. 10(B) is a cross-sectional view thereof, FIG. 10(C) is an enlarged view of a part enclosed in a circle in FIG. 10(A), and FIG. 10(D) is a cross-sectional view taken along line A–A' of FIG. 10(A). For ease of illustration in FIGS. 10(C) and 10(D), a smaller number of conductor lines are shown than the actual number of conductor lines. FIG. 11 is an enlarged view of the resonator.

In FIG. 11, an end portion of a conductor line at an innermost location of a plurality of conductor lines is shown in a circle IE, and an end portion of a conductor line at an outermost location is shown in a circle OE. An area in which end portions of conductor lines face with each other via a gap with a particular gap size is shown in a circle G.

As shown in FIG. 10, a set of conductor lines 12 is formed on the upper surface of a substrate 1. The structure thereof is basically similar to that shown in FIG. 4. However, in this example shown in FIG. 10, the set of conductor lines 12 is formed such the conductor line width changes depending on the locations of the conductor lines in a width direction (along line A–A') in such a manner that a conductor line located at the center has a greatest width and the width decreases with the location of conductor lines in both outward and inward direction. The set of conductor lines 12 is formed by means of a micro fabrication technique such that the widths of conductor lines located near outermost and innermost positions (in a radial direction) are equal to or smaller than the skin depth of the conductor lines and such that the space between any adjacent conductor lines is equal to or smaller than the skin depth of the conductor lines. For example, cupper (with a conductivity of about 53 MS/m) has a skin depth of about 1.5 $\mu$m at 2 GHz, and thus the width of conductor lines at innermost and outermost locations and the space between any adjacent conductor lines are determined to be equal to or smaller than 1.5 $\mu$m.

By setting the width of conductor lines at innermost and outermost locations in width direction of the set of conductor lines 12 and the space between any adjacent conductor lines to a value equal to or smaller than the skin depth, it becomes possible to effectively reduce the current concentration due to the skin effect in end portions of the set of conductor lines 12. Furthermore, by setting the width of conductor lines located near the center in the width direction of the set of conductor lines 12 to a greater value, it becomes possible to increase the current flowing through conductor lines suffering less edge effect, thereby achieving a higher conductor Q-factor.

In the present example, the set of conductor lines 12 is formed such that each conductor line has a substantially rectangular shape. This results in an increase in aperture area in which resonant magnetic energy is stored, compared with that achieved by the circular shape. As a result, it becomes possible to reduce the area in which the set of conductor lines 12 is formed. Furthermore, corners of the rectangle are rounded such that conductor lines do not have abruptly bent parts, thereby preventing currents from concentrating in abruptly bent parts in conductor lines and thus preventing a reduction in conductor Q-factor.

Seventh Embodiment

Figure 12:
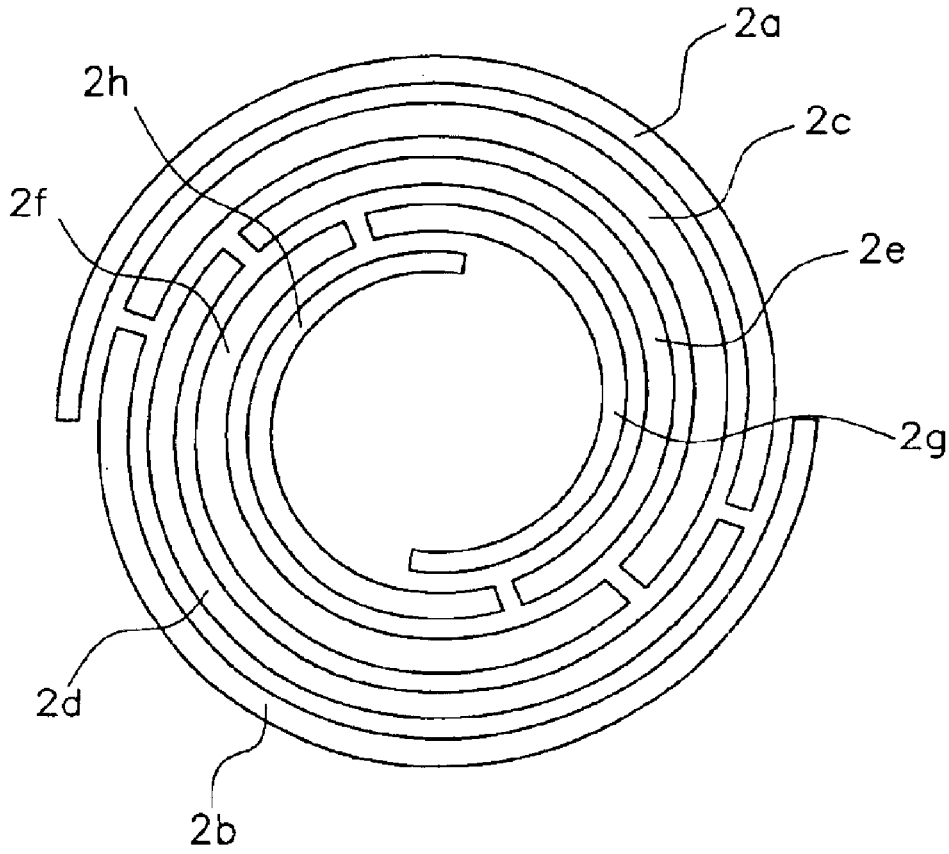
FIG. 12 is a diagram showing an example of a conductor line pattern of a resonator according to a seventh embodiment of the present invention.

FIG. 12 illustrates the structure of a resonator according to a seventh embodiment. Also in this embodiment, the resonator includes a plurality of resonant elements whose structure is basically similar to that shown in FIG. 7(B) except that a set of conductor lines is formed such that the width of conductor lines changes depending on the location in a radial direction in such a manner that the width has a greatest value at the center and decreases toward innermost and outermost locations. In this resonator, unlike the resonator shown in FIG. 10, each resonant element includes two conductor lines. In the example shown in FIG. 12, conductor lines 2*a* and 2*b* form a first resonant element, conductor lines 2*c* and 2*d* form a second resonant element, conductor lines 2*e* and 2*f* form a third resonant element, and conductor lines 2*g* and 2*h* form a fourth resonant element. That is, four resonant elements form one resonator.

The conductor lines are formed by means of a micro fabrication technique such that the widths of conductor lines located near outermost and innermost positions are equal to or smaller than the skin depth of the conductor lines and such that the space between any adjacent conductor lines is equal to or smaller than the skin depth of the conductor lines. In this resonator constructed in the above-described manner, as in the resonator shown in FIG. 10, it is possible to effectively reduce the current concentration due to the skin effect in end portions of the set of conductor lines, thereby allowing the resonator to have a higher conductor Q-factor.

In order to increase the conductor Q-factor of the set of conductor lines, it is required to control the distribution of currents flowing through the respective conductor lines. In the present invention, the currents flowing through the respective conductor lines are controlled by adjusting the capacitance of capacitive parts of the respective conductor lines, taking into account the following factors.

(1) The conductor loss due to the skin effect and edge effect is essentially caused by a current concentration in surfaces or edges. Therefore, it is needed to flatten the distribution of the amplitude of current thereby flattening the distribution of magnetic energy.

(2) The optimum design of the resonator reduces to determining the optimum width of respective conductor lines depending on the current distribution and the magnetic energy distribution, thereby achieving an optimum series of current amplitudes.

(3) In other words, simply dividing a conductor line into a plurality of conductor line having an equal small width does not necessary result in an increase in conductor Q-factor. Depending on the series of currents, the dividing of the conductor line can result in an increase in loss. Furthermore, the conductor lines must have a control mechanism to achieve an optimum series of currents.

Unfortunately, the optimum solution cannot be expressed in a single mathematical function. Therefore, it is needed to determine a better structure by means of iterative calculations. Guidelines for design on the basis of iterative calculations are described below.

(1) When the structure is viewed in cross section perpendicular to current paths, the structure includes a plurality of lines. The conductor line width is monotonically reduced from a maximum value at the center toward both end locations. An optimum series of currents is determined by means of iterative calculation using a FEM simulator.

(2) In order to determine the optimum series of currents, a series of capacitance coupled with respective conductor lines is determined. The optimum series of capacitance can be determined by solving an eigenvalue problem such that a characteristic matrix, calculated by combining an inductance matrix including elements indicating self-inductance of respective conductor lines and elements indicating mutual inductance between conductor lines and a capacitance matrix including diagonal elements indicating a desired series of capacitance, has a desired series of currents as an eigen-vector. Qualitatively, the series of capacitance is determined by the fact that the currents flowing through the respective conductor lines change depending on corresponding capacitance.

Eighth Embodiment

Figure 13:
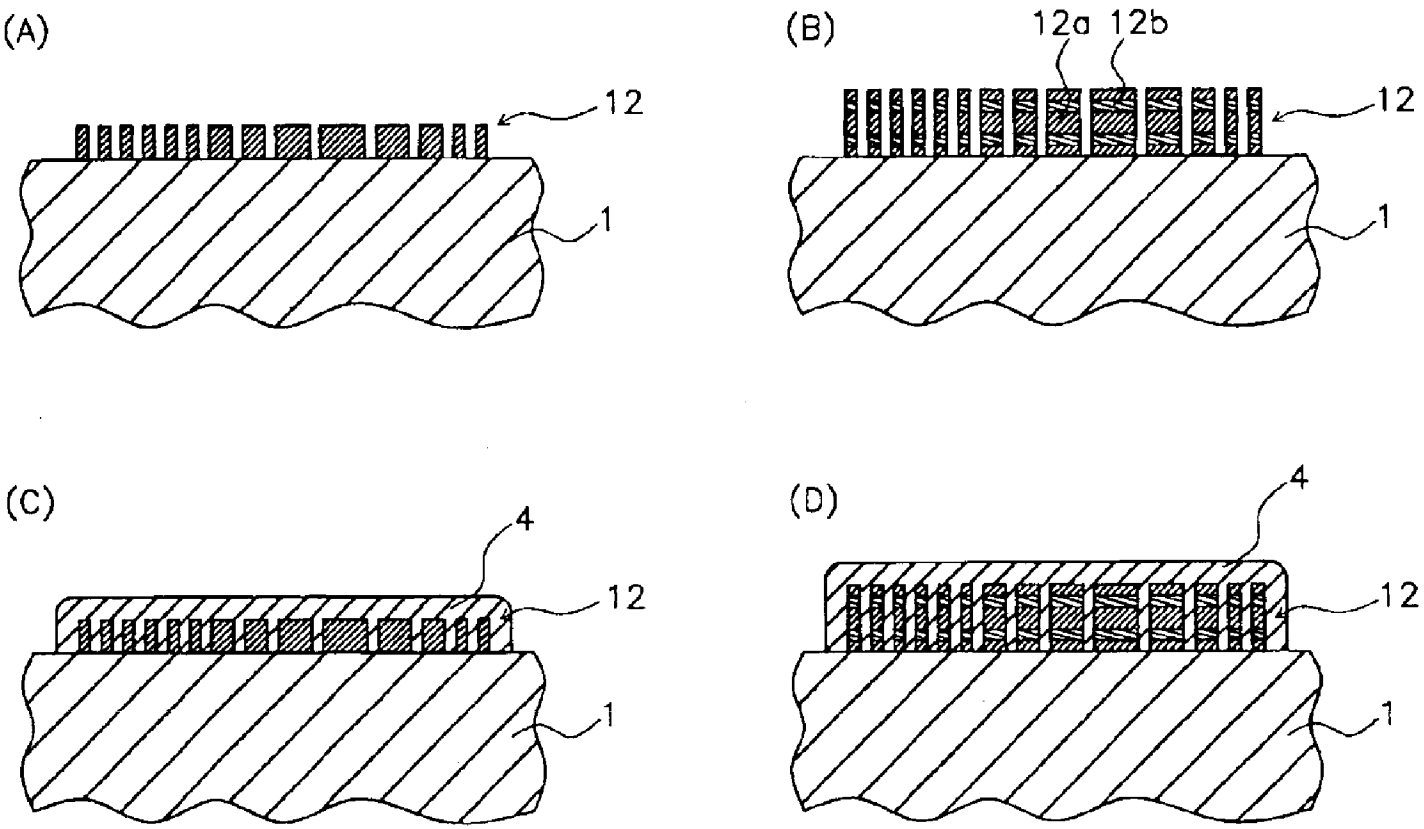
FIG. 13 is a diagram showing a cross-sectional structure of a conductor line of a resonator according to an eighth embodiment of the present invention.

FIG. 13 illustrates the structure of a resonator according to an eighth embodiment, wherein a set of conductor lines 12 formed on a substrate is partially illustrated in the form of an enlarged fashion in FIGS. 13(A) to 13(D). FIG. 13(A) shows a comparative example. In the resonator shown in FIG. 13(A), a set of conductor lines 12 similar to that shown in FIGS. 10 or 11 is formed on the upper surface of a substrate 1. On the other hand, in the resonator shown in FIG. 13(B), the set of conductor lines 12 is constructed such that each of conductor lines is in the form of a thin-film multilayer electrode produced by alternately forming dielectric thin-film layers 12*b* and conductive thin-film layer 12*a* in an one-on-another fashion. By constructing each conductor line in the form of a thin-film multilayer electrode, it becomes possible to reduce the skin effect due to intrusion of a magnetic field from below or above, thereby improving conductor Q-factor at the interface between the substrate and the conductor lines and at the interface between the conductor lines and air.

In the example shown in FIG. 13(C), gaps between adjacent conductor lines of a set of conductor lines 12 are filled with a dielectric material 4. This results in an increase in capacitance of capacitive parts of resonant elements, and thus it becomes possible to reduce the length of each capacitive part and the total size of the resonator.

In the example shown in FIG. 13(D), each of a set of conductor lines 12 is constructed in the form a thin-film multilayer electrode, and gaps between adjacent conductor lines are filled with a dielectric material 4. In this structure, advantages obtained by use of the thin-film multilayer electrode and the advantages obtained by filling the gaps with the dielectric material are achieved.

Ninth Embodiment

Now, referring to FIGS. 14 and 15, a resonator according to a ninth embodiment is described below.

Figure 14:
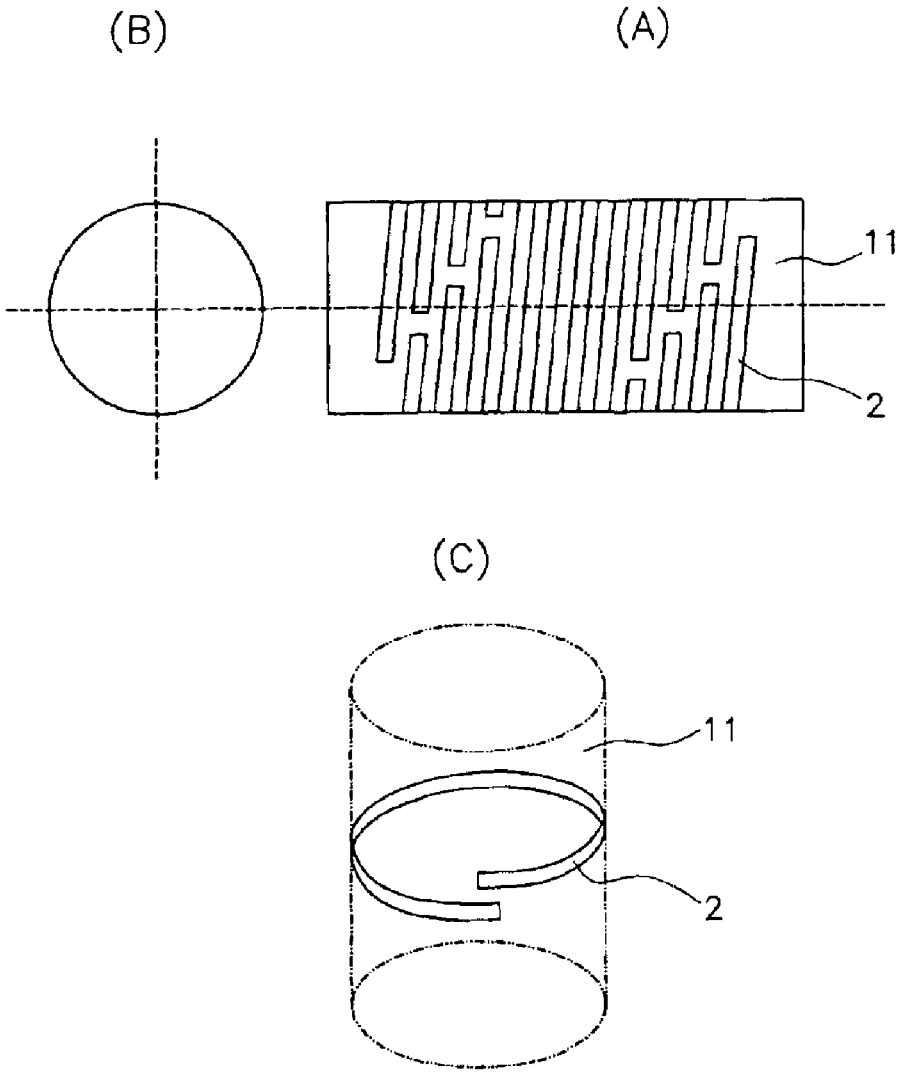
FIG. 14 is a diagram showing a construction of a resonator according to a ninth embodiment of the present invention.

FIG. 14(A) is a front view of the resonator according to the ninth embodiment, and FIG. 14(B) is a left side view thereof. FIG. 14(C) is a perspective view showing the shape of one of conductor lines included in the resonator. As shown in FIG. 14, conductor lines 2 are formed on a side face of a dielectric substrate member 11 in the form of a circular cylinder, thereby forming a plurality of resonant elements. More specifically, as shown in FIG. 14(C), each resonant element is produced by forming a conductor line 2 around the side face of the substrate member 11 by one full turn plus end portions wherein the end portions are located such that they adjoining each other in a width direction. In this example, the conductor lines 2 are formed such that all conductor lines 2 have the same pattern, wherein the conductor lines 2 are located such that they do not overlap with each other and such that capacitive parts of the resonant elements are slightly shifted in a circumferential direction of the conductor lines from one conductor line to another.

The present resonator is equivalent to a resonator obtained by mapping a resonator including conductor lines formed on a plane substrate in a plane coordinate system into a resonator including conductor lines formed around a side face of a circular cylinder in a cylindrical coordinate system. Thus, this resonator operates in a similar manner to that shown in FIG. 4, and similar advantages are achieved. However, as shown in FIG. 4, in the case in which a plurality of conductor lines are disposed on a plane substrate, the length of the capacitive part (the length (angular range) of end portions of conductor lines adjoining each other in the width direction) needed to obtain a particular fixed value of capacitance changes depending on the location in a radial direction. Furthermore, the angular range of the inductive part needed to obtain a particular fixed value of inductance also changes depending on the location in the radial direction. In contrast, in the example shown in FIG. 14, the radius is fixed. Therefore, if the lengths of capacitive parts and inductive parts are expressed in units of angular ranges, the angular ranges are equal for all conductor lines. Thus, the electric field generated among the conductor lines and the currents flowing trough the conductor lines have good symmetry in distribution.

Tenth Embodiment

FIG. 15(A) is a front view of a resonator according to a tenth embodiment, and FIG. 15(B) is a left side view thereof. FIG. 15(C) is a perspective view showing the shape of one of resonant elements composed of conductor lines in the resonator. In this example, each resonant element is composed of two conductor lines. This resonator is equivalent to a resonator obtained by mapping the resonator shown in FIG. 7(B) from the plane coordinate system into a cylindrical coordinate system.

Figure 15:
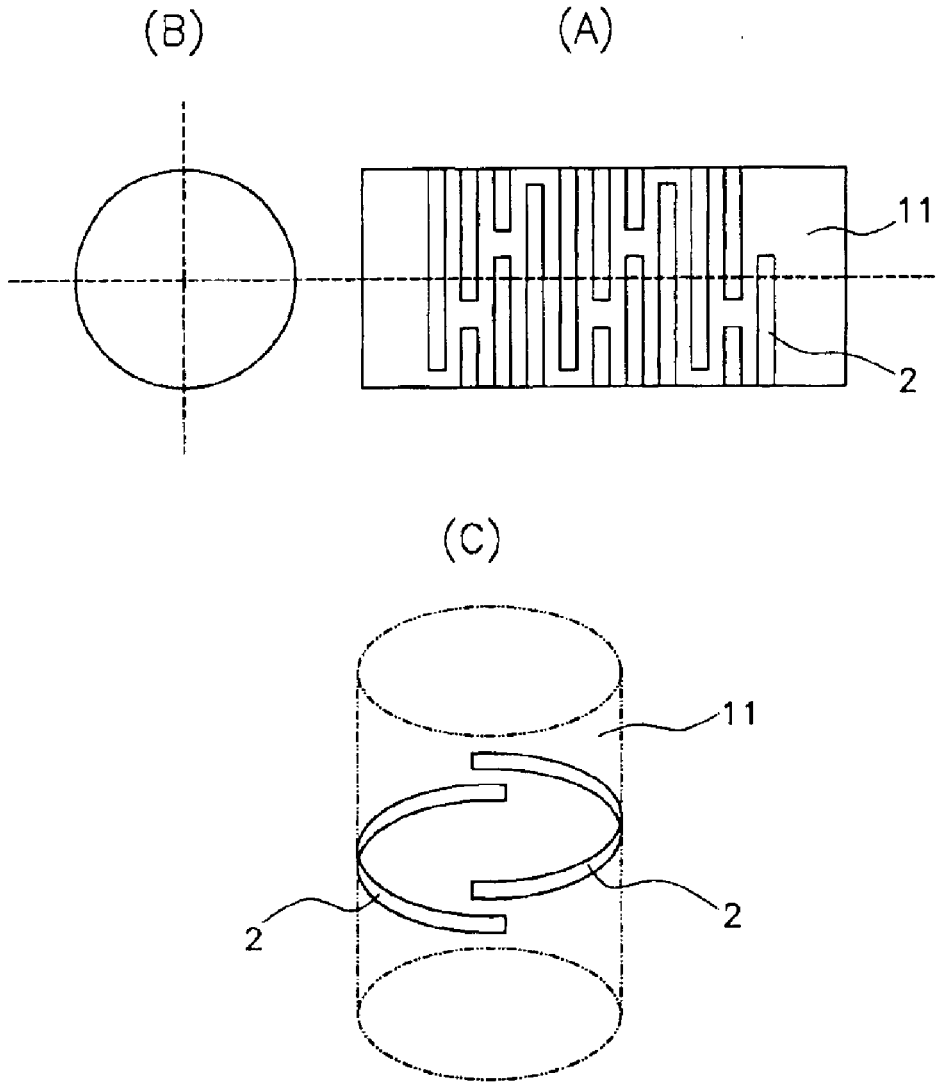
FIG. 15 is a diagram showing a construction of a resonator according to a tenth embodiment of the present invention.

Although in the examples shown in FIGS. 14 and 15, the substrate member in the form of a solid cylinder is used, conductor lines may be formed around a substrate member made of an insulating or dielectric material in the form of a hollow cylinder.

Eleventh Embodiment

Figure 16:
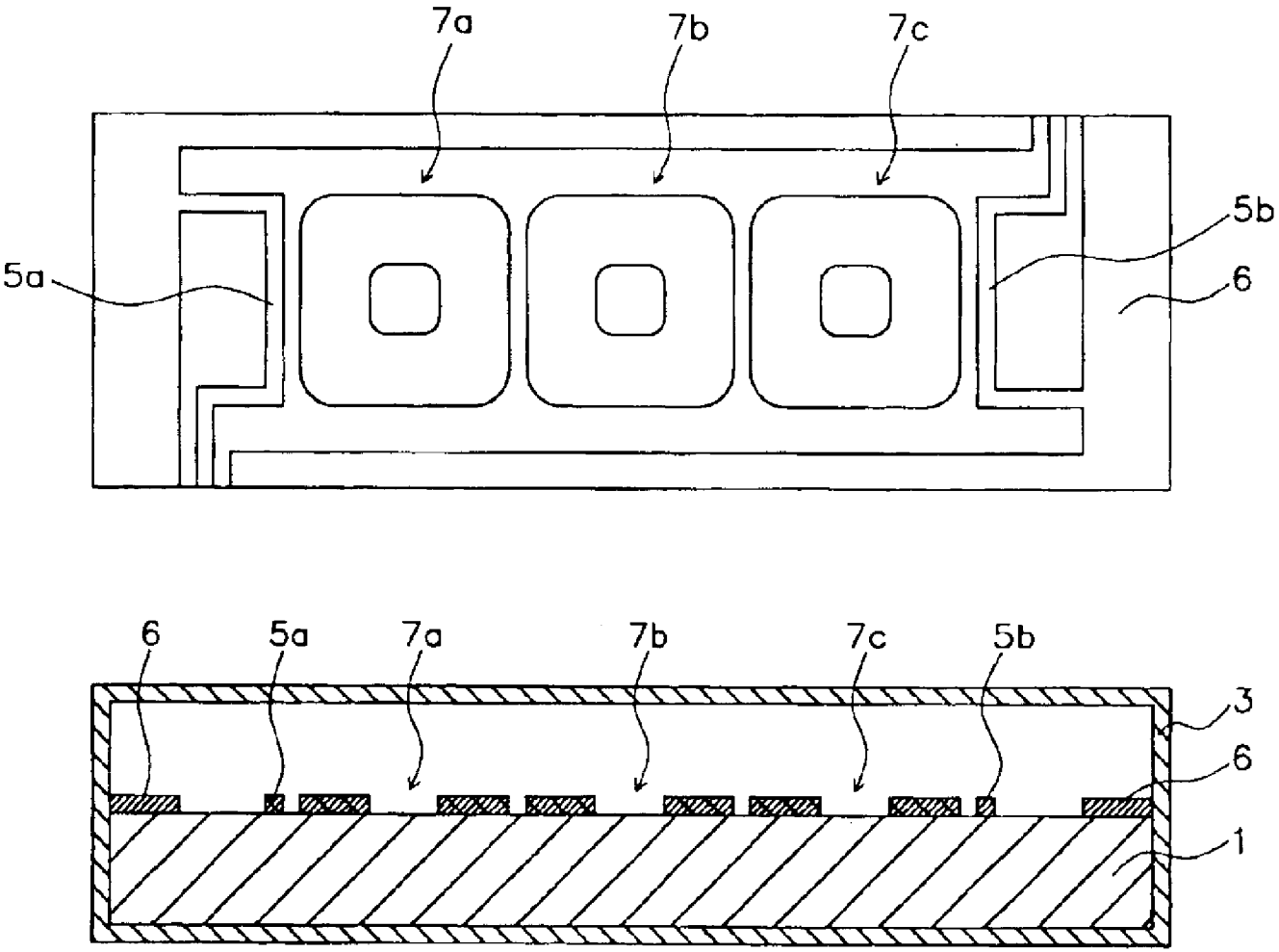
FIG. 16 is a diagram showing a construction of a filter according to an eleventh embodiment of the present invention.

FIG. 16 is a diagram showing a construction of a filter according to an eleventh embodiment. FIG. 16(A) is a top view showing the filter according to the eleventh embodiment, in a state in which a cavity 3 is removed. FIG. 16(B) is a cross-sectional view of the filter.

In FIG. 16, three resonators 7*a*, 7*b*, and 7*c* are formed side by side on the upper surface of a substrate 1. Each of the resonators 7*a*, 7*b*, and 7*c* is similar to that described above with reference to FIGS. 10 and 11. Coupling loops 5*a* and 5*b* for magnetically coupling with resonators 7*a* and 7*c*, respectively, at end locations are formed on the upper surface of the substrate 1. Furthermore, on the upper surface of the substrate 1, there is also provided a ground electrode 6 electrically connected to the shielding cavity 3 within which the substrate 1 is enclosed. One end of each of the coupling loops 5*a* and 5*b* is connected to the ground electrode 6, and the other end extends to the outside of the cavity.

In the three resonators 7*a*, 7*b*, and 7*c*, adjacent two resonators are magnetically coupled with each other via mutual induction of currents. The resonators 7*a* and 7*c* are also magnetically coupled with the coupling loops 5*a* and 5*b*, respectively, via mutual induction of currents. Thus, the present filter has a bandpass characteristic achieved by the three cascaded resonators. The three resonators all have a high Q factor, and thus a low insertion loss is achieved.

Twelfth Embodiment

Figure 17:
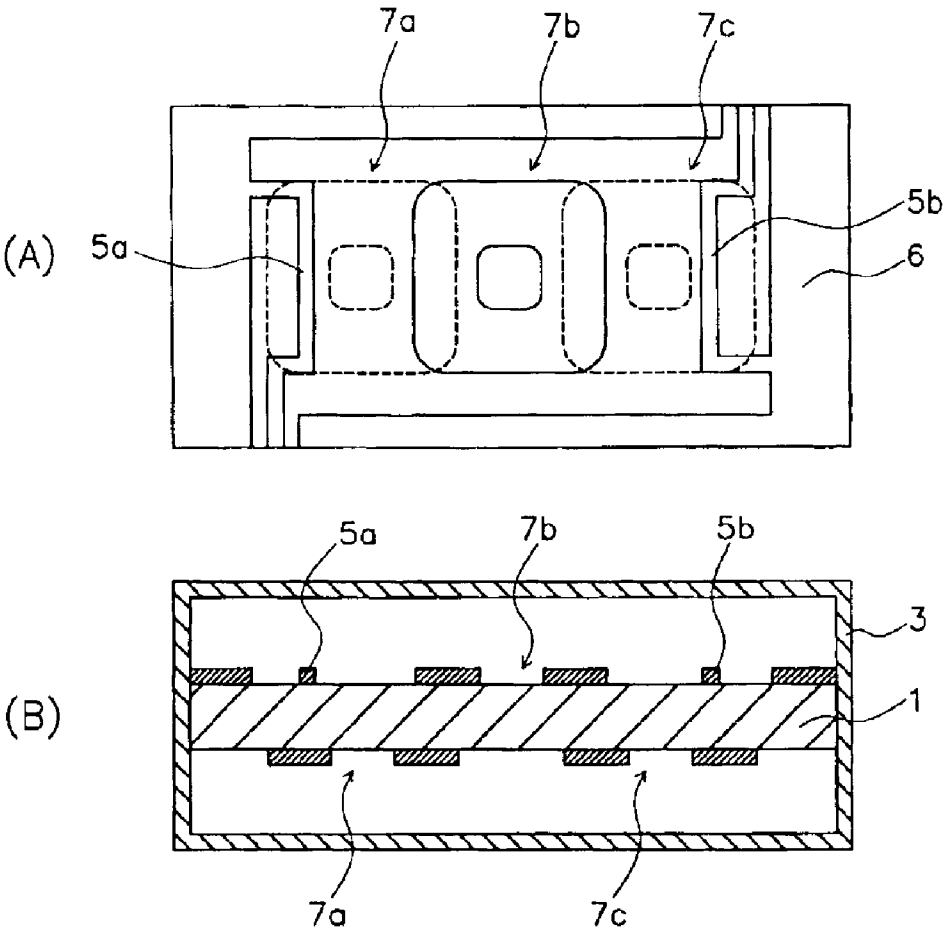
FIG. 17 is a diagram showing a construction of a filter according to a twelfth embodiment of the present invention.

FIG. 17 is a diagram showing a construction of a filter according to a twelfth embodiment. In this example, a resonator 7*b* is formed on the upper surface of a substrate 1, and two resonators 7*a* and 7*c* are formed on the lower surface of the substrate 1. Each of those three resonators 7*a*, 7*b*, and 7*c* is similar to that described above with reference to FIGS. 10 and 11. The three resonators 7*a*, 7*b*, and 7*c* are located such that adjacent resonators partially overlap with each other when seen in a direction perpendicular to the substrate 1. Two coupling loops 5*a* and 5*b* are disposed such that the resonators 7*a* and 7*c* partially overlap with the coupling loops 5*a* and 5*b*, respectively, when seen in the direction perpendicular to the substrate 1.

This structure makes it possible to reduce the size of the substrate 1 compared with the structure shown in FIG. 16, and thus it is possible to reduce the total size and weight of the filter.

Thirteenth Embodiment

Now, referring to FIGS. 18 and 19, a filter according to a thirteenth embodiment is described below.

Figure 18:
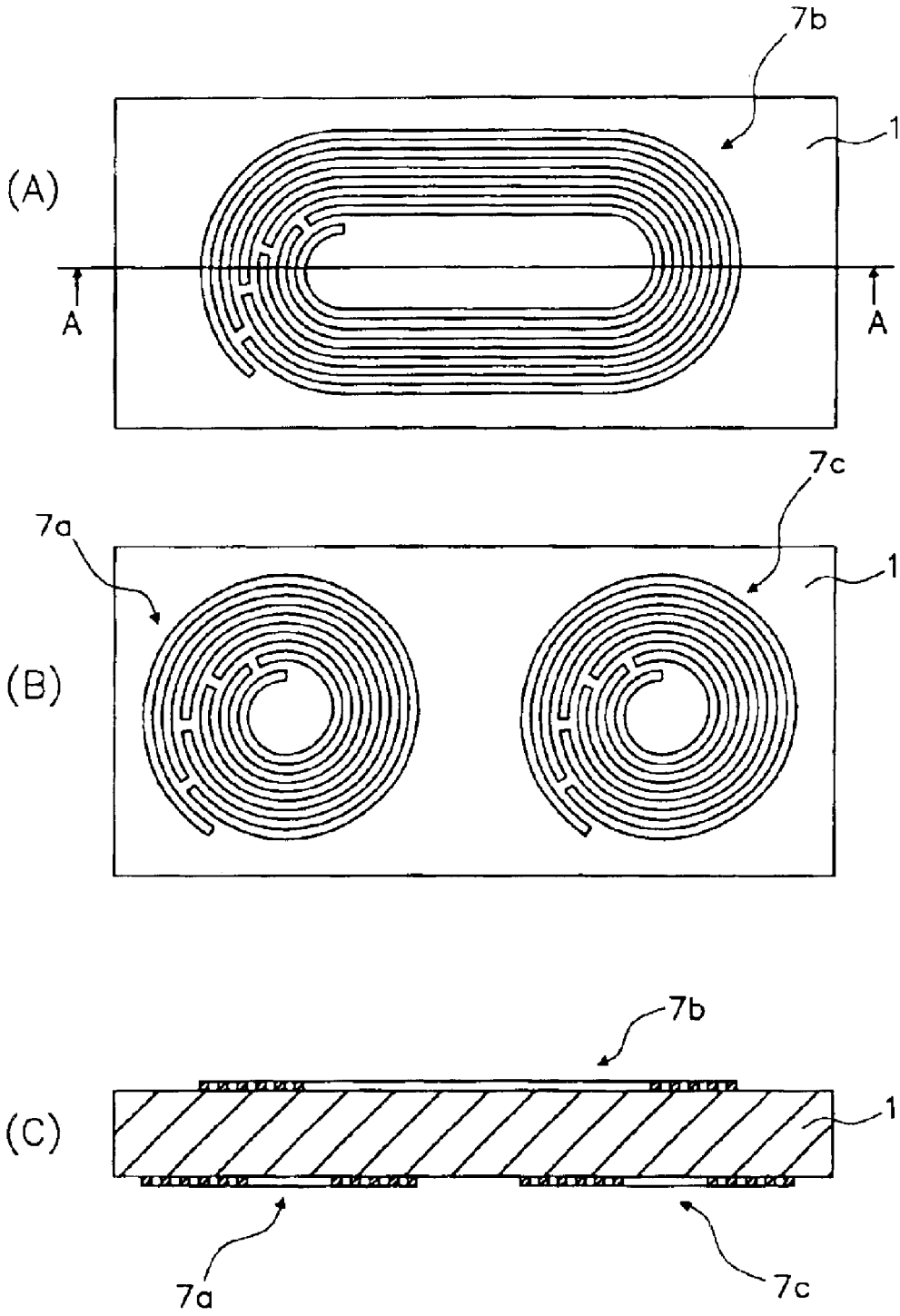
FIG. 18 is a diagram showing a construction of a filter according to a thirteenth embodiment of the present invention.
Figure 19:
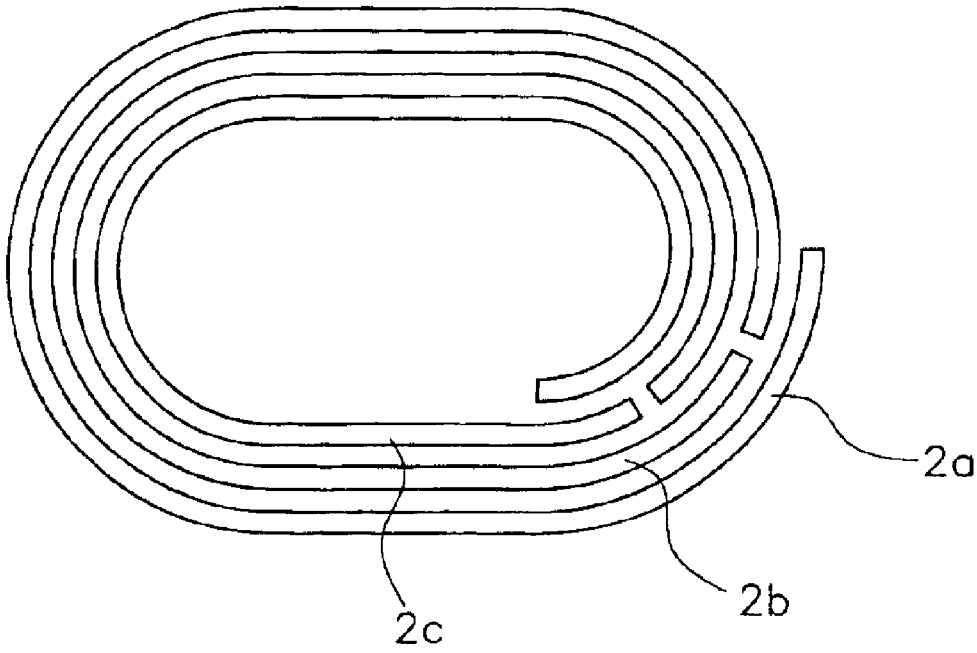
FIG. 19 is a diagram showing an example of a conductor line pattern of the filter according to the thirteenth embodiment of the present invention.

FIG. 18(A) is a top view showing the filter in a state in which a cavity is removed, FIG. 18(B) is a bottom view thereof, and FIG. 18(C) is a cross-sectional view taken along line A–A of FIG. 18(A). In FIG. 18, a resonator 7*b* is formed on the upper surface of a substrate 1, and two resonators 7*a* and 7*c* are formed on the lower surface of the substrate 1. Each of those resonators 7*a*, 7*b*, and 7*c* is similar to that shown in FIG. 4. That is, in each resonant element of those resonators 7*a*, 7*b*, and 7*c*, end portions of each conductor line closely adjoin each other in a width direction. As in the resonator shown in FIG. 4, the locations of capacitive parts of respective resonant elements are slightly shifted from one conductor line to another.

As shown in FIG. 18, the resonator 7*b* formed on the upper surface of the substrate 1 has a generally oblong shape. That is, as shown in FIG. 19, each conductor line has a substantially oblong shape. In the example shown in FIG. 19, three resonant elements are formed by conductor lines 2*a*, 2*b*, and 2*c*.

In the resonators 7*a*, 7*b*, and 7*c* shown in FIG. 18, adjacent resonators are magnetically coupled with each other via mutual induction of currents. Herein, if the resonator 7*a* is used as a first-stage resonator, the resonator 7*b* as a second-stage resonator, and the resonator 7*c* as a third-stage resonator, use of the oblong shape for the second-stage resonator 7*b* results in strong stage-to-stage coupling between the first and second resonators and between the second and third resonators. In the present example, the first-stage and third-stage resonators 7*a* and 7*c* are also coupled with each other (jumping the intermediate resonator). That is, the filter includes three stages of resonators wherein the first-stage resonator and the third-stage resonator are jump coupled. By controlling the strength of the jump coupling, it is possible to adjust a frequency of an attenuation pole which appears near the passband.

Fourteenth Embodiment

Figure 20:
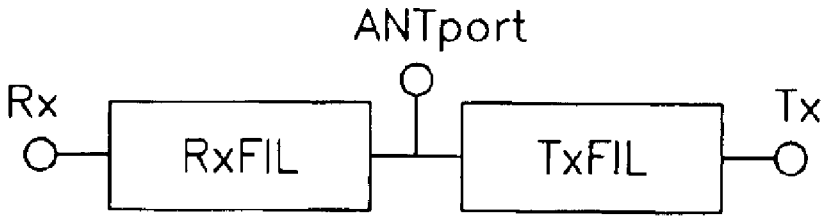
FIG. 20 is a block diagram showing a construction of a duplexer according to a fourteenth embodiment of the present invention.

FIG. 20 shows a duplexer according to a fourteenth embodiment. FIG. 20 is a block diagram showing the duplexer. In this duplexer, filters similar to that shown in FIGS. 16, 17 or 18 are used as a transmitting filter and a receiving filter. The transmitting filter TxFIL and the receiving filter RxFIL are designed so as to have passbands required in transmission and reception. The transmitting filter TxFIL and the receiving filter RxFIL are connected to an antenna terminal ANTport used in common in both transmission and reception, wherein electrical lengths of the connecting lines to the antenna terminal ANTport are adjusted so as to prevent a transmitting signal from intruding into the receiving filter and also to prevent a received signal from intruding into the transmitting filter.

Fifteenth Embodiment

Figure 21:
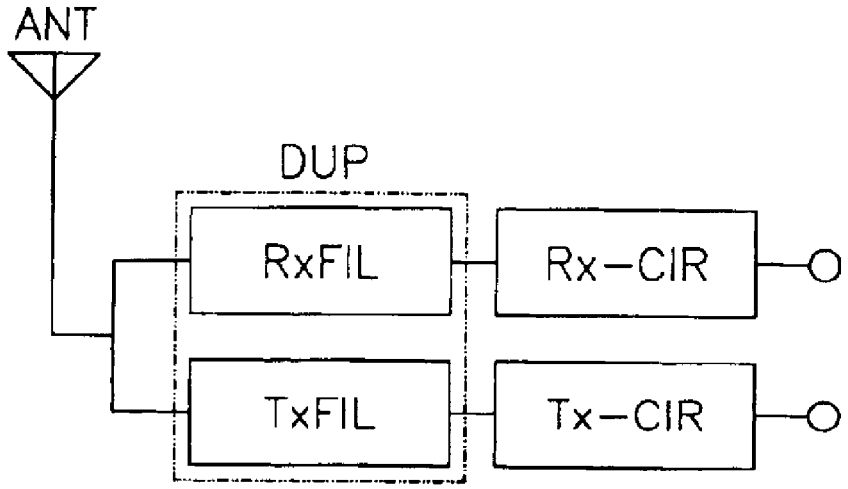
FIG. 21 is a block diagram showing a construction of a communication apparatus according to a fifteenth embodiment of the present invention.

FIG. 21 is a block diagram showing a communication apparatus according to a fifteenth embodiment. In this communication apparatus, the duplexer shown in FIG. 20 is used as a duplexer DUP. A transmitting circuit Tx-CIR and a receiving circuit Rx-CIR are formed on a circuit board. The transmitting circuit Tx-CIR is connected to a transmitting-signal input terminal of the duplexer DUP. The receiving circuit Rx-CIR is connected to a received-signal output terminal of the duplexer DUP. The duplexer DUP is mounted on the circuit board, and an antenna ANT is connected to an antenna terminal.

The present invention has been described above with reference to preferred embodiments. As described above, in the present invention, a resonator is formed of one or more ring-shaped resonant elements, wherein each resonant element includes one or more conductor lines, each resonant element has a capacitive part and an inductive part, and one end portion of each conductor line and the other end portion of the same conductor line closely adjoin each other in a width direction or one end portion of each conductor line and an end portion of another conductor line included in the same resonant element closely adjoin each other in the width direction so that high capacitance is obtained in each area in which end portions of conductor lines adjoin each other thereby allowing a reduction in the size of the resonator. In this structure, it is not needed to form a ground electrode on the surface of the substrate opposite to the surface on the conductor lines. This makes it possible to produce the resonator using a very small number of constituent elements at low cost.

Furthermore, in the present invention, the resonant element may include a plurality of conductor lines and a plurality of capacitive parts. This makes it possible to employ a rather long total length for the ring-shaped resonant element even when the resonant element is used in higher frequencies at which the length of inductive parts must be shortened. Thus, the curvature of the respective conductor lines does not encounter a significant increase, and the current concentration can be eased. As a result, a high conductor Q-factor can be achieved.

Furthermore, in the present invention, the conductor lines may be formed on a plane-shaped substrate. This makes it possible to easily form conductor lines on the substrate, and thus cost reduction can be achieved.

Furthermore, in the present invention, the substrate member may be formed in the shape of a solid cylinder or a hollow cylinder, and conductor lines may be formed around a side face of the substrate member. This makes it possible to apply the invention to a cylindrical structure.

Furthermore, in an embodiment of the present invention, end portions of a conductor line are located in close proximity to each other such that the end portions form an interdigital transducer, thereby allowing a reduction in length of capacitive parts and thus allowing a reduction in the total size of the resonator.

Furthermore, in the present invention, the width of some or all conductor lines and the space between some or all adjacent conductor lines are set to be equal to or smaller than the skin depth of the conductor, thereby reducing the current concentration due to the skin effect and the edge effect and thus increasing the conductor Q-factor of the resonator.

Furthermore, in the present invention, the space between conductor lines adjoining each other in the width direction is set to be substantially constant. This makes is possible to form all conductor lines using a micro-fabrication process under the same condition adapted to forming the smallest pattern, thereby allowing a resonator having high conductor Q-factor to be produced in a highly efficient manner.

Furthermore, in the present invention, the conductor lines may be produced in the form of a thin-film multilayer electrode obtained by alternately forming dielectric thin-film layers and conductive thin-film layer one on another. This allows not only a reduction in the current concentration in the width direction of the conductor lines due to the edge effect but also a reduction in the current concentration due to in the thickness direction of the conductor lines due to the skin effect. Thus, it is possible to further increase the conductor Q-factor of the resonator.

Furthermore, in the present invention, the gaps between adjacent conductor lines may be filled with a dielectric material to increase capacitance formed between adjacent conductor lines of the resonator. This allows a reduction in the length of capacitive parts, and thus a reduction in the size of the resonator.

Furthermore, the present invention also provides a filter and a duplexer having a small size and having a low insertion loss.

Furthermore, the present invention also provides a communication apparatus having a low insertion loss in RF transmitting and receiving circuits and having high transmission performance in terms of, for example, noise characteristic and transmission rate.

INDUSTRIAL APPLICABILITY

As described above, the resonator according to the present invention has the advantage that it can be produced at reasonably low cost so as to have a small size and a high conductor Q-factor. The resonator according to the present invention can be advantageously used in wireless communication or transmission/reception of electromagnetic waves in, for example, a microwave or millimeter-wave band.

What is claimed is:

1. A resonator comprising a plurality of mg-shaped resonant elements, each resonant element including one or more conductor lines, each resonant element having a capacitive part and an inductive part, the capacitive part being formed by locating end portions of conductor lines such that one e portion of a conductor line and the other end portion of the same conductor line closely adjoin each other in a width direction or such that one end portion of a conductor and an end portion of another conductor line included in the same resonant element closely adjoin each other in a width direction, wherein each resonant element includes a pluralily of conductor lines and a plurality of capacitive parts.

2. A resonator according to claim 1, wherein an end of one of the conductor lines and an end of another conductor line adjacent to said one conductor line face each other via a gap with a particular gap distance.

3. A resonator according to claim 1, wherein each conductor line is formed on a plane-shaped substrate.

4. A resonator according to claim 1, wherein each conductor line is formed around a side face of a substrate member in the form of a solid cylinder or a hollow cylinder.

5. A resonator according to claim 1, wherein end portions of a conductor line are located in close proximity to each other such that the end portions form an interdigital transducer.

6. A resonator according to claim 1, wherein, for some or all conductor lines, the width of conductor lines and the space between adjacent conductor lines are set to be equal to or smaller than the skin depth of the conductor lines.

7. A resonator according to claim 1, wherein the space between conductor lines adjoining each other in a width direction is set to be equal to or smaller than the skin depth of the conductor lines.

8. A resonator according to claim 1, wherein the space between conductor lines adjoining each other in a width direction is set to be substantially constant.

9. A resonator according to claim 1, wherein each conductor line is constructed in the form of a thin-film multilayer electrode obtained by alternately forming dielectric thin-film layers and conductive thin-film layers one on another.

10. A resonator according to claim 1, wherein the space between conductor lines adjoining each other in a width direction is filled with a electric material.

11. A filter including a resonator according to claim 1 and a signal input/output means coupled to the resonator.

12. A duplexer including a filter according to claim 11, the filter being used as a transmitting filter or a receiving filter or being used as both a transmitting filter and a receiving filter.

13. A communication apparatus including a duplexer according to claim 12.

14. A communication apparatus including at least a filter according to claim 11.

15. A resonator according to claim 1, wherein a capacitive part formed by one of the conductor lines and a capacitive part formed by another conductor line adjacent to said one conductor line is located in close proximity to each other.

* * * * *